US008758968B2

(12) United States Patent
Watanabe et al.

(10) Patent No.: US 8,758,968 B2
(45) Date of Patent: Jun. 24, 2014

(54) TONER, PRODUCTION METHOD THEREOF, DEVELOPER AND IMAGE FORMING METHOD

(75) Inventors: Naohiro Watanabe, Shizuoka (JP); Tsuyoshi Sugimoto, Shizuoka (JP); Shinya Hanatani, Shizuoka (JP); Mamoru Hozumi, Miyagi (JP); Osamu Uchinokura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 70 days.

(21) Appl. No.: 13/287,522

(22) Filed: Nov. 2, 2011

(65) Prior Publication Data

US 2012/0122027 A1 May 17, 2012

(30) Foreign Application Priority Data

Nov. 12, 2010 (JP) ..... 2010-254174

(51) Int. Cl.
*G03G 9/16* (2006.01)

(52) U.S. Cl.
USPC ..... 430/109.4; 430/105; 430/108.1; 430/108.4; 430/109.1

(58) Field of Classification Search
CPC ..... G03G 9/08782; G03G 9/0821
USPC ..... 430/105, 108.1–108.4, 109.1–109.4
See application file for complete search history.

(56) References Cited

U.S. PATENT DOCUMENTS

| | | | |
|---|---|---|---|
| 5,187,526 | A | 2/1993 | Zaretsky |
| 7,306,887 | B2 | 12/2007 | Tanaka et al. |
| 7,413,839 | B2 | 8/2008 | Matsumoto et al. |
| 7,449,273 | B2 | 11/2008 | Ohki et al. |
| 7,459,255 | B2 | 12/2008 | Tanaka et al. |
| 7,550,243 | B2 | 6/2009 | Matsumoto et al. |
| 7,550,245 | B2 | 6/2009 | Inoue et al. |
| 7,662,532 | B2 | 2/2010 | Tomita |
| 7,718,339 | B2 | 5/2010 | Tomita et al. |
| 7,829,254 | B2 | 11/2010 | Kurose et al. |
| 8,007,977 | B2 | 8/2011 | Inoue et al. |

(Continued)

FOREIGN PATENT DOCUMENTS

| | | | |
|---|---|---|---|
| CN | 101059664 | A | 10/2007 |
| CN | 101301595 | A | 11/2008 |

(Continued)

OTHER PUBLICATIONS

Office Action issued Jan. 31, 2013 in Chinese Application No. 201110359408.4 (With English Translation).

(Continued)

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

To provide a toner, containing: a binder resin; a crystalline polyester resin; a colorant; and wax, wherein the toner has a fluidized powder characteristic value of 35% to 45%, and a BET specific surface area of 2.8 $m^2/g$ to 4 $m^2/g$, and wherein the toner has an intensity ratio P2850/P828 of 0.10 to 0.20, where P2850 is an intensity of a peak at 2850 $cm^{-1}$ which is attributed from the wax and the crystalline polyester resin, and P828 is an intensity of a peak at 828 $cm^{-1}$ which is attributed from the binder resin, as measured by total reflectance infrared spectroscopy.

9 Claims, 3 Drawing Sheets

(56) References Cited

U.S. PATENT DOCUMENTS

| | | | | |
|---|---|---|---|---|
| 8,034,524 | B2 | 10/2011 | Inoue et al. | |
| 2006/0040194 | A1* | 2/2006 | Sugiura et al. | 430/108.4 |
| 2006/0068312 | A1* | 3/2006 | Yamashita et al. | 430/109.4 |
| 2007/0218390 | A1 | 9/2007 | Nozaki et al. | |
| 2007/0243478 | A1 | 10/2007 | Maeyama | |
| 2008/0096119 | A1 | 4/2008 | Yamamoto et al. | |
| 2008/0102393 | A1 | 5/2008 | Hasegawa | |
| 2009/0075195 | A1 | 3/2009 | Shu et al. | |
| 2009/0169270 | A1* | 7/2009 | Fuwa et al. | 399/279 |
| 2010/0216068 | A1 | 8/2010 | Kotsugai et al. | |
| 2010/0310980 | A1 | 12/2010 | Sugimoto et al. | |
| 2011/0002719 | A1 | 1/2011 | Shu et al. | |
| 2011/0076612 | A1 | 3/2011 | Awamura et al. | |
| 2011/0223532 | A1 | 9/2011 | Sugimoto et al. | |
| 2011/0236812 | A1* | 9/2011 | Ishihara et al. | 430/105 |

FOREIGN PATENT DOCUMENTS

| | | | |
|---|---|---|---|
| CN | 101308339 | A | 11/2008 |
| CN | 101308340 | A | 11/2008 |
| JP | 2-66559 | | 3/1990 |
| JP | 2-87159 | | 3/1990 |
| JP | 2-146557 | | 6/1990 |
| JP | 2-167566 | | 6/1990 |
| JP | 5-61251 | | 3/1993 |
| JP | 5-113696 | A | 5/1993 |
| JP | 10-97095 | | 4/1998 |
| JP | 11-174731 | | 7/1999 |
| JP | 2007-286202 | | 11/2007 |
| JP | 2007-304332 | | 11/2007 |
| JP | 2008-225130 | | 9/2008 |
| JP | 2008-276005 | | 11/2008 |
| JP | 2009-3361 | | 1/2009 |
| JP | 4267427 | | 2/2009 |
| JP | 2009-229621 | | 10/2009 |
| JP | 4518479 | | 5/2010 |
| JP | 2010-204431 | | 9/2010 |
| JP | 2011-118128 | | 6/2011 |
| WO | WO 2009/142010 | A1 | 11/2009 |

OTHER PUBLICATIONS

Combined Chinese Office Action and Search Report issued Oct. 8, 2013 in Patent Application No. 201110359408.4 with English Translation and English Translation of Category of Cited Documents.

* cited by examiner

TONER, PRODUCTION METHOD THEREOF, DEVELOPER AND IMAGE FORMING METHOD

BACKGROUND OF THE INVENTION

1. Field of the Invention

The present invention relates to a toner and production method thereof, and a developer and image forming method using the toner.

2. Description of the Related Art

Hereto, various methods have been known as an electrophotographic method. The electrophotographic method generally a method includes forming a latent electrostatic image on a latent electrostatic image bearing member (may also be referred to as an "electrophotographic photoconductor" or "photoconductor") by means of various units, developing the latent electrostatic image with a toner to form a visible image, transferring the visible image, if necessary, to a recording medium such as paper, and fixing the visible image onto the recording medium with heat and/or pressure to thereby provide a copy or print.

A common electrophotographic method with a full color photocopier is a method where four latent electrostatic image bearing members are used to form a latent electrostatic image on each member, latent electrostatic images are respectively developed with a cyan toner, magenta toner, yellow toner, and black toner, the resulting toner images are transferred to a recording medium, which is conveyed on a belt transfer member, to thereby form a full color image. Another method is a method where a recording medium is mechanically wrapped on a surface of a recording medium bearing member, which is disposed to face one latent electrostatic image bearing member, by electrostatic force or a gripper, and a series of the operations from the developing to transferring is repeated 4 times to thereby produce a full color image.

As an image forming method using an intermediate transfer member, proposed are a method where a full-color image forming apparatus equipped with a drum-shaped intermediate transfer member is used (see U.S. Pat. No. 5,187,526).

In these proposed methods, however, the visible image once transferred from the latent electrostatic image bearing member to the intermediate transfer member needs to be transferred again to a recording medium, and thus it is necessary to enhance transfer efficiency of the toner even higher than before.

Moreover, compared to the case of a single black color toner used in a monochrome photocopier, it is difficult to improve transfer efficiency of the color toners as an amount of the toners present on an intermediate transfer member is increased in a full color copier. Therefore, a 4-color visible image is not easily transferred uniformly, causing a partial transfer failure, so called a hollow defect.

In a transferring step, the recording medium and the intermediate transfer member are generally charged to have the opposite polarity to that of the toner, so that the toner is transferred by the electrostatic force.

During the transferring step of the toner with the electrostatic force, if transfer bias is increased to improve transfer efficiency of the toner, the charging amount of the toner is decreased, or is charged to have an opposite polarity by discharge occurred between the toner or latent electrostatic image bearing member and the recording medium (this may also referred to as "leak of toner charge" hereinafter). As a result of the leak of the toner charge, a phenomenon, so called retransfer, occur. This phenomenon is that the toner transferred to a recording medium moves back to the latent electrostatic image bearing member. Particularly in the case where the transferring step is performed a few times, as in the case of the aforementioned full-color image forming method, retransfer is more likely to occur with the toner which has been transferred earlier, and the retransfer of the toner results in formations of images with low image density. As the retransfer occur, unevenness is appeared in a resulting image. Therefore, high quality images cannot be formed.

In order to improve transfer efficiency of a toner, various methods for subjecting the toner to a treatment to give the toner mechanical impacts have been proposed (see JP-A Nos. 02-66559, 02-87159, 02-146557, 02-167566, and 05-61251).

As a result of these proposed methods, the transfer efficiency of the toner improves to some extent, but not to the sufficient level. Especially in the case of an image forming device using an intermediate transfer member, the transfer efficiency of such a toner is insufficient, and use of the toner does not give any effect in the prevention of the retransfer of the toner.

Moreover, for preventing the retransfer of the toner, proposed is a method for regulating a circularity distribution of the toner having a particle diameter of 3 μm or larger and having at least one endothermic peak in the temperature region of 120° C. as measured by differential scanning calorimetry (see JP-A No. 10-97095).

Moreover, it is disclosed that by controlling external additives contained in the toner having a certain circularity distribution and a certain weight average particle diameter to have the average particle diameter and shape factor within certain ranges on the toner particles, high quality images accurately reproducing minute dots can be attained, and the toner is not easily deteriorated by the high mechanical stress in a developing unit (see JP-A No. 11-174731).

The conventional art has not yet provided a toner having high transfer efficiency without causing retransferring, excellent low temperature fixing ability, and capable of forming high quality images, as well as providing a method for producing such a toner, and a developer and image forming method using such a toner. Therefore, it is currently strongly desired to promptly provide a toner having high transfer efficiency, excellent low temperature fixing ability, and capable of forming high quality images, as well as providing a method for producing such a toner, and a developer and image forming method using such a toner.

SUMMARY OF THE INVENTION

The present invention aims to provide a toner having high transfer efficiency without causing retransferring, excellent low temperature fixing ability, and capable of forming high quality images, as well as providing a method for producing such a toner, and a developer and image forming method using such a toner.

The means for solving the problems mentioned above are as follows:

<1> A toner, containing:

a binder resin;

a crystalline polyester resin;

a colorant; and wax, wherein the toner has a fluidized powder characteristic value of 35% to 45%, and a BET specific surface area of 2.8 $m^2/g$ to 4 $m^2/g$, and wherein the toner has an intensity ratio P2850/P828 of 0.10 to 0.20, where P2850 is an intensity of a peak at 2850 $cm^{-1}$ which is attributed from the wax and the crystalline polyester resin, and P828 is an intensity of a peak at 828 $cm^{-1}$ which is attributed from the binder resin, as measured by total reflectance infrared spectroscopy.

<2> The toner according to <1>, further containing a wax dispersant.

<3> The toner according to any of <1> or <2>, wherein the crystalline polyester resin has a weight average molecular weight Mw of 3,000 to 30,000, a number average molecular weight Mn of 1,000 to 10,000, and a ratio Mw/Mn of 1 to 10, where the ratio Mw/Mn is a ratio of the weight average molecular weight Mw of the crystalline polyester resin to the number average molecular weight Mn of the crystalline polyester resin.

<4> The toner according to any one of <1> to <3>, wherein the crystalline polyester resin has a molecular weight distribution in which a proportion of the crystalline polyester resin having a number molecular weight of 500 or smaller is 0% to 2%, and a proportion of the crystalline polyester resin having a number molecular weight of 1,000 or smaller is 0% to 4%.

<5> The toner according to any one of <1> to <4>, wherein the crystalline polyester resin is synthesized from a C4-C12 saturated dicarboxylic acid and a C4-C12 saturated diol.

<6> The toner according to any one of <1> to <5>, wherein the crystalline polyester resin is contained in the toner in an amount of 5% by mass to 25% by mass.

<7> The toner according to any one of <2> to <6>, wherein the toner is a toner obtained by the method containing:

dispersing an oil phase in an aqueous medium to form an O/W dispersion liquid, where the oil phase is prepared by dissolving or dispersing in an organic solvent a toner material containing at least the crystalline polyester resin, a non-crystalline polyester resin, the colorant, the wax, and the wax dispersant; and removing the organic solvent from the O/W dispersion liquid.

<8> The toner according to any one of <2> to <7>, wherein the toner is a toner obtained by the method containing:

dispersing an oil phase in an aqueous medium to form an emulsified dispersion liquid, where the oil phase is prepared by dissolving or dispersing in an organic solvent a toner material containing at least a compound containing an active hydrogen group, a binder resin precursor containing a site reactive to the compound containing an active hydrogen group, the crystalline polyester resin, a non-crystalline polyester resin, the colorant, the wax, and the wax dispersant;

allowing the binder resin precursor to react with the compound containing an active hydrogen group in the emulsified dispersion liquid; and removing the organic solvent from the emulsified dispersion liquid.

<9> The toner according to any one of <2> to <8>, wherein the wax dispersant is a graft polymer of a polyolefin resin and alkyl(meth)acrylate.

<10> The toner according to any one of <1> to <9>, wherein the wax is paraffin wax, microcrystalline wax, or a combination of paraffin wax and microcrystalline wax.

<11> The toner according to any one of <1> to <10>, the wax is contained in the toner in an amount of 1% by mass to 10% by mass.

<12> The toner according to any one of <1> to <11>, wherein the toner has a volume average particle diameter of 3 μm to 8 μm.

<13> The toner according to any one of <1> to <12>, wherein the toner has a ratio Dv/Dn of 1 to 1.25, where the ratio Dv/Dn is a ratio of a volume average particle diameter Dv of the toner to a number average particle diameter Dn of the toner.

<14> The toner according to any one of <1> to <13>, wherein the toner has Tg2nd of 20° C. or higher but lower than 40° C., where Tg2nd is a glass transition temperature of the toner for a second temperature elevation as measured by a differential scanning calorimeter.

<15> A method for producing a toner, containing:

allowing an oil phase to react in an aqueous medium to form an emulsified dispersion liquid, where the oil phase is prepared by dissolving or dispersing in an organic solvent a toner material containing at least a compound containing an active hydrogen group, a binder resin precursor containing a site reactive to the compound containing an active hydrogen group, a crystalline polyester resin, a non-crystalline polyester resin, a colorant, wax, and a wax dispersant;

adding water to the emulsified dispersion liquid; and removing the organic solvent from the emulsified dispersion, wherein the toner is the toner as defined in any one of <2> to <14>.

<16> The method for producing a toner according to <15>, wherein an amount of the wax dispersant in the oil phase is 30% by mass to 100% by mass relative to an amount of the wax.

<17> The method for producing a toner according to any of <15> or <16>, further containing adding 5 parts by mass to 40 parts by mass of water to 100 parts by mass of the emulsified dispersion liquid.

<18> A developer containing the toner as defined any one of <1> to <14>.

<19> An image forming method, containing:

forming a latent electrostatic image on a latent electrostatic image bearing member;

developing the latent electrostatic image with the toner as defined in any one of <1> to <14> to form a visible image;

transferring the visible image to a recording medium; and fixing the transferred image onto the recording medium.

The present invention can solve the various problems in the art, achieves the object mentioned above, and provide a toner having high transfer efficiency without causing retransferring, excellent low temperature fixing ability, and capable of forming high quality images, as well as providing a method for producing such a toner, and a developer and image forming method using such a toner.

DETAILED DESCRIPTION OF THE INVENTION (Toner)

Figure 1A:
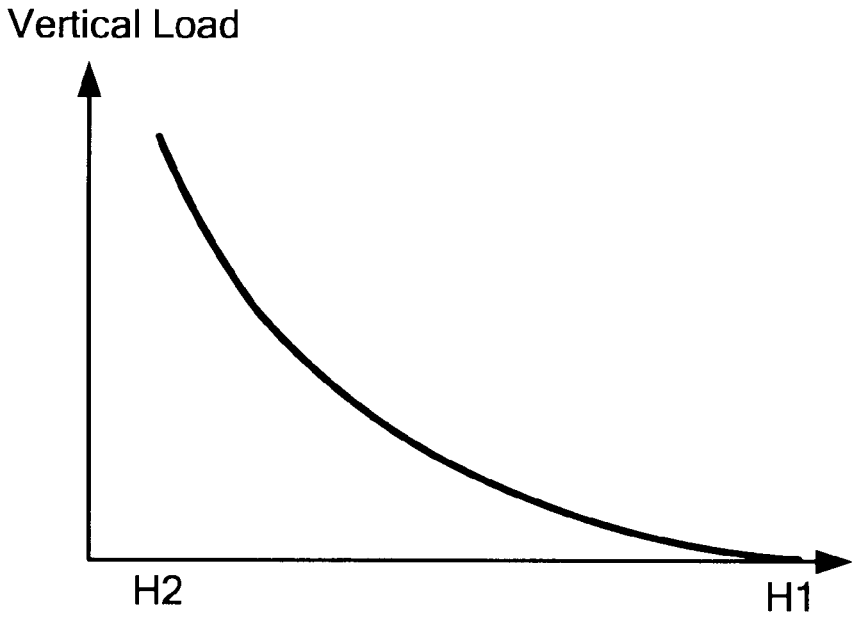
FIG. 1A is a diagram illustrating a relationship between a height from the bottom surface in the measurement of the fluidity of the toner and the vertical load.

The toner of the present invention contains a binder resin, a crystalline polyester resin, a colorant, and wax, preferably a wax dispersion liquid, and may further contain other components, if necessary.

The toner of the present invention has the fluidized powder characteristic value, BET specific surface area, and the intensity ratio of the peak intensity attributed from the crystalline polyester resin and the wax, and the peak intensity attributed from the binder resin in the following certain numerical ranges. By satisfying these conditions, the resulting toner has high transfer efficiency without causing retransfer, and excellent low temperature fixing ability, and is capable of forming high quality images.

<Fluidized Powder Characteristic Value of Toner>

The fluidized powder characteristic value of the toner is an index indicating the fluidity of the toner.

The fluidized powder characteristic value of the toner is 35% to 45%, preferably 37% to 43%.

When the fluidized powder characteristic value is lower than 35%, or higher than 45%, the toner has insufficient transfer ability.

The fluidized powder characteristic value of the toner can be determined, for example, by means of a powder rheometer (FT4, manufactured by Malvern Instruments Ltd.).

As a sample of the toner, the toner that has been left to stand for 8 hours or longer in the environment having the temperature of 22° C. and the humidity of 50% RH is used to avoid any influence of the temperature and humidity in the measurement.

At first, a split vessel having an inner diameter of 50 mm (including a 160 mL vessel having a height of 89 mm, and a cylinder having a height of 51 mm and disposed above the vessel so that the split vessel can be separated into an upper part and a lower part) is charged with the toner in an amount sufficient to fill the vessel to or over the height of 89 mm. Then, the sample is homogenized by gently stirring the charged toner. Note that, the homogenization of the sample is referred to as conditioning, hereinafter. The conditioning is performed as it is important to stably attain a powder at a constant volume for stably determining a flow energy amount.

For the conditioning, stirring is gently performed with a rotor in the rotational direction that does not receive resistance from the toner so as not to apply excessive stress to the toner filled in the vessel. In this manner, excess air, or partial stress is almost removed, to thereby turn the sample into a uniform state.

As for the conditions of the conditioning, the stirring is performed at an angle of approach of 5°, and tip speed of 60 mm/sec. During this operation, a propeller rotor (e.g., propeller) moves downwards at the same time as the rotating motion, so that the tip of the propeller rotor spirally moves. Note that, the angle that the spiral motion of the tip of the propeller makes is referred to as "an angle of approach" hereinafter.

After repeating the operation of the conditioning four times, the upper edge part of the split vessel is quietly moved, and the toner within the vessel was leveled at the height of 89 mm, to thereby obtain the toner filling the 160 mL-vessel. The obtained toner is transferred to a 200 mL-vessel having an inner diameter of 50 mm, and height of 140 mm.

After performing the series of the operations mentioned above three times, the running torque and vertical load of the propeller rotor are measured under the conditions that the rotor is rotated at the tip speed of 100 mm/sec and moved in the vessel from the height of 100 mm to 10 mm from the bottom surface of the vessel with the angle of approach of −5°. Note that, the rotational direction of the propeller for this is a reverse direction to the direction during the conditioning.

Figure 1B:
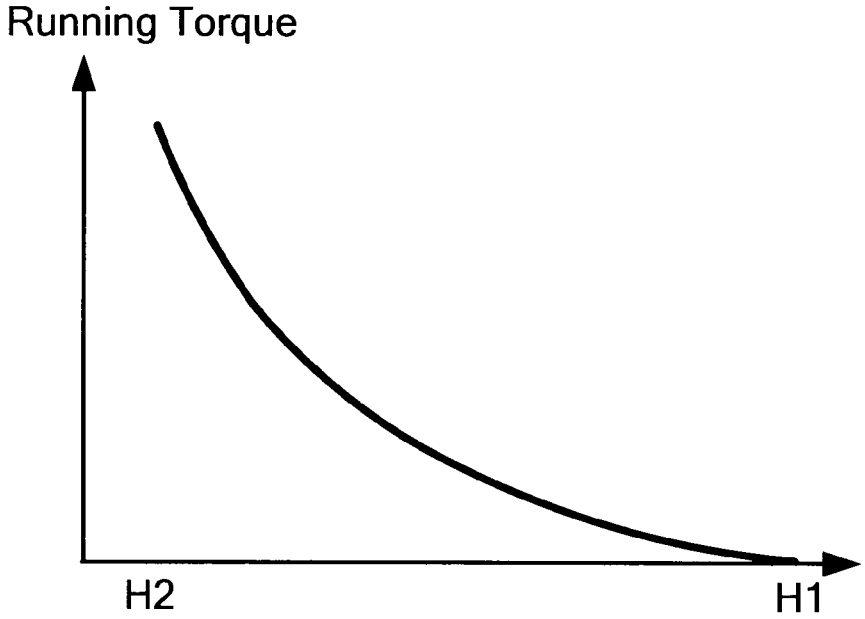
FIG. 1B is a diagram illustrating a relationship between a height from the bottom surface in the measurement of the fluidity of the toner and the running torque.

The relationship between the height H from the bottom surface and the vertical load, and the relationship between H and the running torque are illustrated in FIGS. 1A and 1B, respectively.

Figure 2:
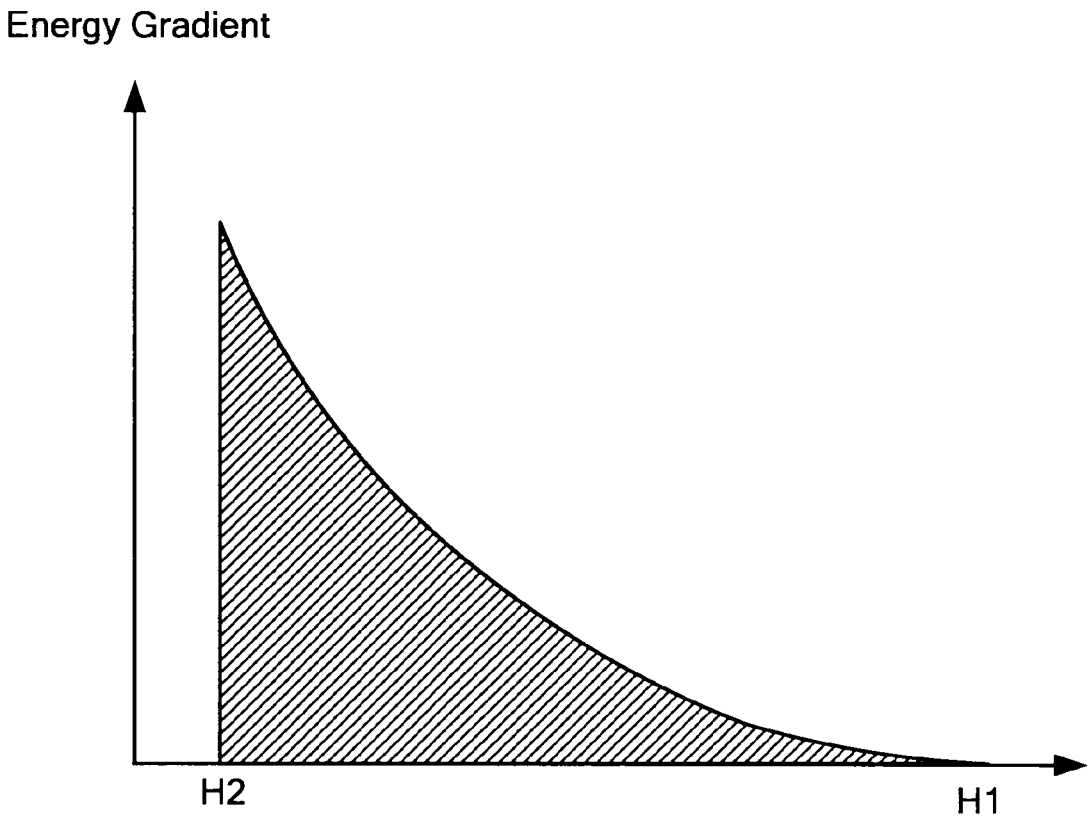
FIG. 2 is a diagram for explaining a method for determining the energy gradient from the running torque and the vertical load in the measurement of the fluidity of the toner.

FIG. 2 illustrates the energy gradient (mJ/mm) with respect to the height H, which is obtained from the running torque and vertical load. The area (the part marked with slanting lines in FIG. 2) obtained by integrating the energy gradient is the flow energy amount (mJ). The flow energy amount is determined by integrating the section from the height that is 10 mm from the bottom surface to the height that is 100 mm from the bottom surface. In order to reduce the influence from an error, the average value obtained after performing a cycle of the conditioning and aeration with the maximum quantity of air flow of 80 L/min 5 times is determined as the flow energy amount (mJ), and the average value after measuring the flow energy amount 5 times without aeration is determined as a pre-aeration flow energy amount (mJ). The fluidized powder characteristic value is obtained based on the following equation.

Fluidized powder characteristic value(%)=(flow energy amount/pre-aeration flow energy amount)×100

Figure 3:
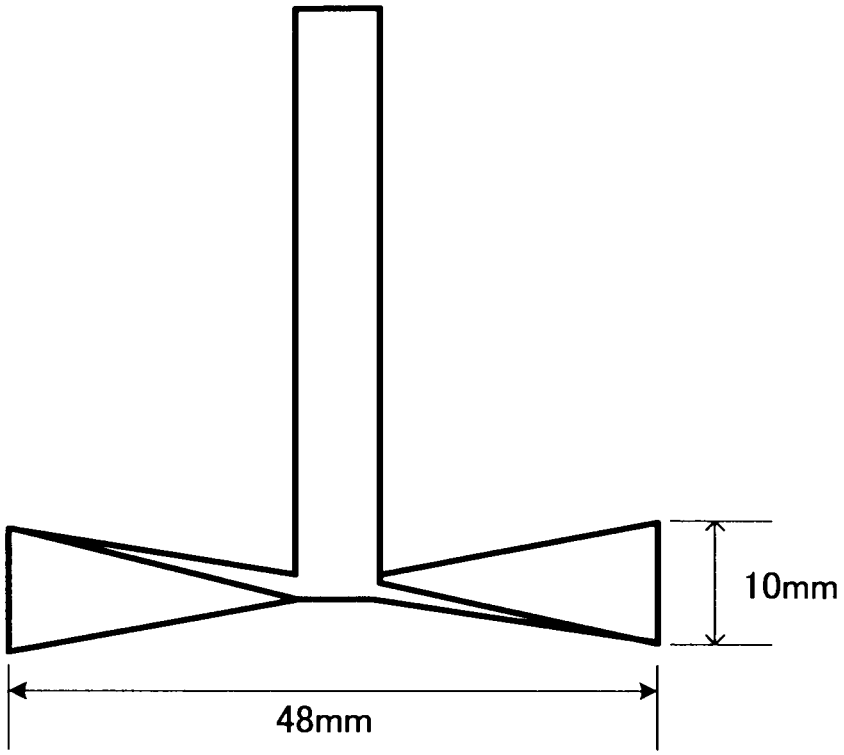
FIG. 3 is a diagram illustrating a twin propeller rotor used in the measurement of the fluidity of the toner.

Note that, as the propeller, a 48 mm-diameter blade (see FIG. 3) of a standard accessory kit (for 200 mL vessel) of the used propeller powder rheometer FT4 can be used.

<BET Specific Surface Area of Toner>

The BET specific surface area of the toner is 2.8 $m^2/g$ to 4 $m^2/g$, preferably 3.0 $m^2/g$ to 3.9 $m^2/g$.

When the BET specific surface area is smaller than 2.8 $m^2/g$, the resulting toner may have poor low temperature fixing ability. When the BET specific surface area is larger than 4 $m^2/g$, irregularities on surfaces of toner particles increase so that a contact area between toner particles increases. Due to the increased contact area between toner particles, the resulting toner may have poor flowability, which may impair transfer ability of the toner to an intermediate transfer member or paper.

The BET specific surface area can be measured, for example, by means of an automatic specific surface area/pore distribution measuring device (TriStar3000, manufactured by Shimadzu Corporation). Specifically, about 0.5 g of the toner is weight and placed in a sample cell, and the sample is then vacuum dried for 24 hours by a pretreatment device (SmartPrep, manufactured by Shimadzu Corporation) to thereby remove impurities and moisture from the surfaces of the toner particles. After the pretreatment, the sample is then set in the measuring device mentioned above (TriStar3000, manufactured by Shimadzu Corporation), a relationship between the absorption amount of the nitrogen gas and the relative pressure is determined. From this relationship, the BET specific surface area can be determined in accordance with a BET multi-point method.

<Intensity Ratio (P2850/P828) of Toner>

The toner of the present invention has the intensity ratio (P2850/P828) of 0.10 to 0.20, where P2850 is an intensity of a peak at 2850 $cm^{-1}$ which is attributed from the wax and the crystalline polyester resin, and P828 is an intensity of a peak at 828 $cm^{-1}$ which is attributed from the binder resin.

When the intensity ratio (P2850/P828) is less than 0.10, an amount of the wax seeping out from an image formed of the toner is small during fixing, and thus hot offset resistance, and releasability between paper, and a fixing belt or roller may be impaired. When the intensity ratio (P2850/P828) is greater than 0.20, large amounts of the wax and crystalline polyester resin are present on surfaces of toner particles so that the adhesive force of the toner to other member increases, which may result in poor flowability of the toner, and poor transfer ability of the toner to an intermediate transfer member or paper.

The intensity ratio (P2850/P828) can be measured, for example, by total reflectance infrared spectroscopy (FTIR-ATR), and indicates the relative amount of the wax adjacent to a surface of a toner particle.

<Crystalline Polyester Resin>

The crystalline polyester resin can be synthesized from an alcohol component, such as a C2-C12 saturated diol compound (e.g. 1,4-butanediol, 1,6-hexanediol, 1,8-octanediol, 1,10-decanediol, 1,12-dodecanediol, and derivatives thereof), and an acid component including at least a C2-C12 dicarboxylic acid having a double bond (C═C), or a C2-C12 saturated carboxylic acid (e.g. fumaric acid, 1,4-butanedioic acid, 1,6-hexanedioic acid, 1,8-octanedioic acid, 1,10-decanedioic acid, 1,12-dodecanedioic acid, and derivatives thereof). Among them, the crystalline polyester resin consisted of the saturated C4-C12 diol component selected from 1,4-butanediol, 1,6-hexanediol, 1,8-octanediol, 1,10-decanediol, and 1,12-dodecanediol, and the saturated C4-C12 dicarboxylic acid component selected from 1,4-butanedioic acid, 1,6-hexanedioic acid, 1,8-octanedioic acid, 1,10-decanedioic acid, and 1,12-dodecanedioic acid is particularly preferable because the resulting crystalline polyester resin has high crystallinity and shows drastic viscosity change at around the melting point thereof.

As a method for controlling the crystallinity and softening point of the crystalline polyester resin, there is a method in which a trihydric or higher polyhydric alcohol such as glycerin is added to the alcohol component and trivalent or higher polycarboxylic acid such as trimellitic anhydride is added to the acid component to proceed to a condensation polymerization to yield a non-linear polyester, and such non-linear polyester is designed and used during the synthesis of polyester.

The molecular structure of the crystalline polyester resin can be confirmed by X-ray diffraction, GC/MS, LC/MS, and IR measurements, as well as NMR of a solution or solid thereof. A simple method is that the molecular structure thereof is confirmed by an infrared absorption spectrum thereof having an absorption attributed from δCH (out-of-plane deformation vibration) of olefin at 965 $cm^{-1}$±10 $cm^{-1}$ or 990 $cm^{-1}$±10 $cm^{-1}$.

Regarding the molecular weight of the crystalline polyester resin, the crystalline polyester resin with a sharp molecular weight distribution and low molecular weights has excellent low temperature fixing ability, and the crystalline polyester resin having a large amount of low molecular weight crystalline polyester molecules has poor heat resistance storage stability.

The weight average molecular weight of the o-dichlorobenzene soluble component of the crystalline polyester resin as measured by gel permeation chromatography (GPC) is preferably 3,000 to 30,000, more preferably 5,000 to 20,000.

When the weight average molecular weight thereof is smaller than 3,000, the resulting toner may have poor heat resistance storage stability. When the weight average molecular weight thereof is greater than 30,000, the resulting toner may have poor low temperature fixing ability.

The number average molecular weight of the crystalline polyester resin is preferably 1,000 to 10,000.

When the number average molecular weight thereof is smaller than 1,000, the resulting toner may have poor heat resistance storage stability. When the number average molecular weight thereof is greater than 10,000, the resulting toner may have poor low temperature fixing ability.

The ratio Mw/Mn of the weight average molecular weight Mw of the crystalline polyester resin to the number average molecular weight Mn of the crystalline polyester resin is preferably 1 to 10.

When the ratio Mw/Mn is smaller than 1, the resulting toner may have poor low temperature fixing ability. When the ratio Mw/Mn thereof is greater than 10, the resulting toner may have poor heat resistance storage stability.

Both low temperature fixing ability and heat resistance storage stability of the toner is achieved when the crystalline polyester resin for use has the crystalline polyester resin having a number molecular weight of 500 or smaller in the proportion of 0% to 2%, and the crystalline polyester resin having a number molecular weight of 1,000 or smaller in the proportion of 0% to 4%.

When the proportion of the crystalline polyester resin having the number molecular weight of 500 or smaller is more than 2%, the resulting toner may have poor heat resistance storage stability.

When the proportion of the crystalline polyester resin having the number molecular weight of 1,000 or smaller is more than 4%, the resulting toner may have poor heat resistance storage stability.

The melting point of the crystalline polyester resin is preferably 60° C. to 80° C. When the melting point of the crystalline polyester resin is lower than 60° C., the resulting toner may have poor heat resistance storage stability. When the melting point thereof is higher than 80° C., the resulting toner may have poor low temperature fixing ability.

The melting point of the crystalline polyester resin can be measured, for example, by using a DSC system (differential scanning calorimeter) or the like.

Given that the acid value of the crystalline polyester resin is defined as A and the hydroxyl value of the crystalline polyester resin is defined as B, the crystalline polyester resin preferably satisfies the following relational expressions:

$$10\text{mgKOH/g} < A < 40\text{mgKOH/g}$$

$$0\text{mgKOH/g} < B < 20\text{mgKOH/g}$$

$$20\text{mgKOH/g} < A+B < 40\text{mgKOH/g}$$

When the acid value A of the crystalline polyester resin is 10 mgKOH/g or lower, the resulting toner may have poor compatibility to paper, which is a recording member, and this may result in poor heat resistance storage stability. When the acid value A of the crystalline polyester resin is 40 mgKOH/g or higher, or the hydroxyl value B of the crystalline polyester resin is 20 mgKOH/g or lower, the resulting toner may have poor charging ability in the high temperature high humidity environment.

When the sum of the acid value and hydroxyl value thereof is 20 mgKOH/g or lower, the crystalline polyester resin has low compatibility to the non-crystalline polyester resin, this may result in insufficient low temperature fixing ability of the toner. When the sum of the acid value and hydroxyl value thereof is 40 mgKOH/g or higher, the compatibility between the crystalline polyester resin and the non-crystalline polyester resin is excessively high, the resulting toner may have poor heat resistance storage stability.

The acid value and hydroxyl value can be measured in accordance with the method specified in JIS K0070.

An amount of the crystalline polyester resin in the toner is preferably 5% by mass to 25% by mass, more preferably 5% by mass to 20% by mass. When the amount thereof is smaller than 5% by mass, the resulting toner may have poor low temperature fixing ability. When the amount thereof is greater than 25% by mass, the resulting toner may have poor heat resistance storage stability, and productivity of the toner may be impaired.

The solubility of the crystalline polyester resin to the organic solvent of 70° C. is preferably 10 parts by mass or more. When the solubility thereof is less than 10 parts by mass, the compatibility between the organic solvent and the crystalline polyester resin is poor, and therefore it is difficult to disperse the crystalline polyester resin to the size of submicron order in the organic solvent. As a result, the crystalline polyester resin is unevenly present in the toner, this may result poor charging ability of the toner, or poor image quality of images formed with the resulting toner after long period of use.

The solubility of the crystalline polyester resin to the organic solvent of 20° C. is preferably less than 3.0 parts by mass. When the solubility thereof is 3.0 parts by mass or more, the crystalline polyester resin dissolved in the organic solvent tends to be compatible to the non-crystalline polyester resin even before heating, this may result poor resistance storage stability of the resulting toner, contaminations of the developing unit, and deterioration in qualities of images formed with the resulting toner.

The organic solvent is preferably an organic solvent, which can dissolve the crystalline polyester resin completely at high temperature to form a uniform solvent, and can cause a phase separation with the crystalline polyester resin once cooled to form an opaque heterogeneous solution.

Examples of the organic solvent include toluene, ethyl acetate, butyl acetate, methyl ethyl ketone, and methyl isobutyl ketone. These may be used independently, or in combination.

Since the crystalline polyester resin in the toner has high crystallinity, the toner has such thermofusion properties that the toner decreases its viscosity largely at around the fixing onset temperature. Specifically, the toner has excellent heat resistance stability doe to the crystallinity of the crystalline polyester resin just under the melting onset temperature, and decreases its viscosity largely (exhibiting sharp melting properties) at the melting onset temperature to be fixed. Therefore, the toner having both excellent heat resistance storage stability and low temperature fixing ability can be obtained. Moreover, the toner also has excellent fusing latitude (i.e. a range between the lowest fixing temperature and the hot offset temperature.

<Dissolution and Recrystallization Method of Crystalline Polyester Resin in Organic Solvent>

A method of dissolving and recrystallizing the crystalline polyester resin in the organic solvent is as follows.

Firstly, a crystalline polyester resin (10 g) and an organic solvent (90 g) are stirred for 1 hour at 70° C.

Secondly, the solution obtained after the stirring is cooled over 12 hours at 20° C. to thereby recrystallize the crystalline polyester resin.

Then, the dispersion liquid, in which the recrystallized crystalline polyester resin is dispersed in the organic solvent, is introduced into KIRIYAMA funnel (manufactured by Kiriyama Glass Co., Ltd.) where filter paper No. 4 (manufactured by Kiriyama Glass Co., Ltd.) for KIRIYAMA funnel is set, and is subjected to suction filtration by an aspirator, to separate into the organic solvent and the crystalline polyester resin. The crystalline polyester resin obtained by the separation is dried for 48 hours at 35° C., to thereby yield the recrystallized crystalline polyester resin.

<Evaluation of Solubility of Crystalline Polyester Resin to Organic Solvent>

The solubility of the crystalline polyester resin to the organic solvent is determined by the following method.

A crystalline polyester resin (20 g) and an organic solvent (80 g) are stirred for 1 hour at the predetermined temperature. The solution obtained from the stirring is introduced into KIRIYAMA funnel (manufactured by Kiriyama Glass Co., Ltd.) where filter paper No. 4 (manufactured by Kiriyama Glass Co., Ltd.) for KIRIYAMA funnel is set, and is subjected to suction filtration by an aspirator at the predetermined temperature, to separate into the organic solvent and the crystalline polyester resin. The organic solvent obtained after the separation is heated for 1 hour at the temperature that is the boiling point of the organic solvent+50° C. to evaporate the organic solvent. Based on the change in the weight before and after the heating, the amount of the crystalline polyester resin dissolved in the organic solvent is calculated.

The toner of the present invention is preferably a toner obtained by the method containing: dispersing, in an aqueous medium, an oil phase in which a toner material containing at least the crystalline polyester resin, non-crystalline polyester resin, colorant, wax, and wax dispersant is dissolved or dispersed in an organic solvent, to form an O/W dispersion liquid; and removing the organic solvent from the O/W dispersion liquid.

Moreover, the toner of the present invention is preferably a toner obtained by the method containing: dispersing, in an aqueous medium, an oil phase, in which a toner material containing at least a compound containing an active hydrogen group, a binder resin precursor having a site reactive with the compound containing an active hydrogen group, the crystalline polyester resin, a non-crystalline polyester resin, a colorant, wax, and wax dispersant is dissolved or dispersed in an organic solvent, to form an emulsified dispersion liquid; allowing the binder resin precursor and the compound containing the active hydrogen group to react in the emulsified dispersion liquid; and removing the organic solvent from the emulsified dispersion liquid.

<Binder Resin>

The binder resin is appropriately selected depending on the intended purpose without any restriction, but it preferably contains a non-crystalline polyester resin, a modified polyester resin, an unmodified polyester resin, and other binder resins.

<<Binder Resin Precursor and Modified Polyester Resin>>

As the binder resin precursor, polyester prepolymer modified with isocyanate or epoxy can be used. By reacting the polyester prepolymer with the compound containing an active hydrogen group to perform a crosslink and/or elongation reaction, a modified polyester resin (i.e., a modified polyester resin containing a urethane bond and/or urea bond) is obtained. By using the modified polyester resin, the resulting toner can have an appropriate degree of the crosslink structure, which enhances improvement of fusing latitude (i.e. a range between the lowest fixing temperature and the hot offset temperature).

The modified polyester resin can be produced by a one-shot method, or the like. As one example, a production method of a urea-modified polyester resin will be explained hereinafter.

At first, polyol and polycarboxylic acid are heated to 150° C. to 280° C. in the presence of a catalyst such as tetrabutoxy titanate, and dibutyl tin oxide, optionally removing generated water under the reduced pressure, to thereby yield a polyester resin containing a hydroxyl group. Next, the polyester resin containing a hydroxyl group and polyisocyanate are allowed to react at 40° C. to 140° C., to yield polyester prepolymer containing an isocyanate group. Then, the polyester prepolymer containing an isocyanate group and amines are allowed to react at 0° C. to 140° C. to yield a urea-modified polyester resin.

A number average molecular weight (Mn) of the urea-modified polyester resin is preferably 1,000 to 10,000, more preferably 1,500 to 6,000.

Note that, a solvent is optionally used for the reaction between the polyester resin containing a hydroxyl group and the polyisocyanate, and the reaction between the polyester prepolymer containing an isocyanate group and the amines.

The solvent is appropriately selected depending on the intended purpose without any restriction. Examples thereof include inert compounds to the isocyanate group, such as aromatic solvents (e.g. toluene, and xylene), ketones (e.g. acetone, methyl ethyl ketone, and methyl isobutyl ketone), esters (e.g. ethyl acetate), amides (e.g. dimethylformamide, and dimethylacetoamide), and ethers (e.g. tetrahydrofuran).

—Polyester Prepolymer—

The polyester prepolymer can be easily synthesized by reacting, with a polyester resin (base reactant), an isocyanating agent, an epoxidizing agent, etc. which are conventionally known. Examples of the isocyanating agent include: aliphatic polyisocyanate (e.g., tetramethylene diisocyanate, hexamethylene diisocyanate, and 2,6-diisocyanate methyl caproate); alicyclic polyisocyanate (e.g. isophorone diisocyanate, and cyclohexylmethane diisocyanate); aromatic diisocyanate (e.g. tolylene diisocyanate, and diphenylmethane diisocyanate); aromatic aliphatic diisocyanate (e.g. $\alpha,\alpha,\alpha',\alpha'$-tetramethyl xylylene diisocyanate); isocyanirates; the polyisocyanates mentioned above, each of which is blocked with a phenol derivative, oxime, caprolactam, or the like; and a combination of any of those listed. Moreover, a representative example of the epoxidizing agent is epichlorohydrin, or the like.

A ratio of the isocyanating agent is determined as an equivalent ratio [NCO]/[OH] of the isocyanate group [NCO] to the hydroxyl group [OH] of the polyester as a base, and the equivalent ratio [NCO]/[OH] is preferably 5/1 to 1/1, more preferably 4/1 to 1.2/1, and even more preferably 2.5/1 to 1.5/1. When the equivalent ratio [NCO]/[OH] is larger than 5/1, the resulting toner may have poor low temperature fixing ability.

When the molar ratio of [NCO] is smaller than 1, the urea content of the polyester prepolymer is low, and therefore the resulting toner may have poor hot offset resistance.

An amount of the isocyanating agent in the polyester prepolymer is preferably 0.5% by mass to 40% by mass, more preferably 1% by mass to 30% by mass, and even more preferably 2% by mass to 20% by mass. The amount of the isocyanating agent is smaller than 0.5% by mass, the hot-offset resistance of the resulting toner is poor, and it may be disadvantageous in attaining both the heat resistance storage stability and the low temperature fixing ability. When the amount thereof is greater than 40% by mass, the low temperature fixing ability of the resulting toner may be poor.

Moreover, the number of the isocyanate groups per molecule of the polyester prepolymer is generally 1 or more, preferably 1.5 to 3 on average, and more preferably 1.8 to 2.5 on average. When the number of the isocyanate groups per molecule is less than 1, the molecular weight of the urea-modified polyester resin after the elongation reaction is small, this may result in poor hot-offset resistance of the resulting toner.

The weight average molecular weight of the polyester prepolymer is preferably $1\times10^4$ to $3\times10^5$.

—Compound Containing Active Hydrogen Group—

The compound containing an active hydrogen group is a compound capable of undergoing an elongation reaction or crosslink reaction with the binder resin precursor (prepolymer) having a functional group reactive to the active hydrogen group of the compound containing an active hydrogen group, and representative examples of the compound include amines.

Examples of the amines include a diamine compound, a tri or higher polyamine compound, an amino alcohol compound, an aminomercaptan compound, an amino acid compound, and the preceding compounds whose amino group is blocked.

Examples of the diamine compound include: aromatic diamine (e.g. phenylene diamine, diethyl toluene diamine, and 4,4'-diaminodiphenyl methane); alicyclic diamine (e.g. 4,4'-diamino-3,3'-dimethyldichlorohexyl methane, diamine cyclohexane, and isophorone diamine); and aliphatic diamine (e.g. ethylene diamine, tetramethylene diamine, and hexamethylene diamine). Examples of the tri or higher polyamine compound include diethylene triamine, and triethylene tetramine. Examples of the amino alcohol compound include ethanol amine, and hydroxyethyl aniline. Examples of the aminomercaptan compound include aminoethylmercaptan, and aminopropylmercaptan.

Examples of the amino acid compound include amino propionic acid, and amino caproic acid. Examples of the compound whose amino group is blocked include an oxazolidine compound and ketimine compound derived from the amines and ketones (e.g., acetone, methyl ethyl ketone and methyl isobutyl ketone). Among these amines, the diamine compound alone, or a mixture of the diamine compound and a small amount of the polyamine compound is preferable.

<<Non-Crystalline Polyester Resin>>

The non-crystalline polyester resin obtained by using a polyhydric alcohol component, and a polycarboxylic acid component such as polycarboxylic acid, polycarboxylic anhydride, and polycarboxylic acid ester.

Note that, in the present specification, the term "non-crystalline polyester resin" describes a resin obtained by using a polyhydric alcohol component, and a polycarboxylic acid component such as polycarboxylic acid, polycarboxylic anhydride, and polycarboxylic acid ester, as mentioned above, and a modified polyester resin, for example, the below-mentioned prepolymer, and modified polyester resin obtained by the crosslink and/or elongation reaction of the prepolymer (i.e. a modified polyester resin containing a urethane bond and/or urea bond) are not regarded as the non-crystalline polyester resin, and are defined as a modified polyester resin in the present specification.

The polyhydric alcohol component is appropriately selected depending on the intended purpose without any restriction. Examples of the polyhydric alcohol component include: alkylene(C2-C3)oxide adduct (average added mole number of 1 to 10) of bisphenol A such as polyoxypropylene (2.2)-2,2-bis(4-hydroxyphenyl)propane, and polyoxyethylene(2.2)-2,2-bis(4-hydroxyphenyl)propane; and others such as ethylene glycol, propylene glycol, neopenthyl glycol, glycerin, pentaerythritol, trimethylolpropane, hydrogenated bisphenol A, sorbitol, or alkylene(C2-C3)oxide adduct (average added mole number of 1 to 10) of the preceeding compounds. These may be used independently, or in combination.

The polyhydric carboxylic acid component is appropriately selected depending on the intended purpose without any restriction. Examples thereof include: dicarboxylic acid such as adipic acid, phthalic acid, isophthalic acid, terephthalic acid, fumaric acid, and maleic acid; C1-C20 alkyl group-substituted or C2-C20 alkenyl group-substituted succinic acid such as dodecenyl succinic acid, and octyl succinic acid; others such as trimellitic acid, and pyromellitic acid; and anhydrides or alkyl(C1-C8) esters of the preceding acids. These may be used independently, or in combination.

The non-crystalline polyester resin, the prepolymer, and the resin obtained by the crosslink and/or elongation reaction of the prepolymer (i.e., the modified polyester resin containing a urethane bond and/or urea bond) are appropriately selected depending on the intended purpose without any restriction, but these are preferably compatible to each other at least at part thereof. The compatibility of these polymers contributes to the improvement of the low temperature fixing ability and hot offset resistance of the resulting toner. To make them compatible to each other, the polyhydric alcohol component and polycarboxylic acid component constituting the non-crystalline polyester resin and the polyhydric alcohol component and polycarboxylic acid component constituting the prepolymer are preferably identical or similar.

Given that the acid value of the crystalline polyester resin is defined as A and the acid value of the non-crystalline polyester resin is defined as C, the crystalline polyester resin and the non-crystalline polyester resin preferably satisfy the relational expression:

$$-10\text{mgKOH/g}<A-C<10\text{mgKOH/g},$$

When the value deducted the acid value of the non-crystalline polyester from that of the crystalline polyester resin is 10 or more, the crystalline polyester resin and the non-crystalline polyester resin may have poor compatibility to each other, this may result in poor low temperature fixing ability of the resulting toner. In addition, the crystalline polyester resin tends to be extruded onto a surface of the toner particle, this may cause the contamination of the developing unit, or filming.

The binder resin component contained in the oil phase may contain the crystalline polyester resin, the non-crystalline polyester resin, the binder resin precursor, and the unmodified polyester resin in combination, and, in addition to these, may further contain other binder resin materials. The binder resin component preferably contains a polyester resin, more preferably contains the polyester resin in an amount of 50% by mass or more. When the amount of the polyester resin is less than 50% by mass, the resulting toner may have poor low temperature fixing ability. It is particularly preferred that the entire binder resin component be formed of the polyester resin (including the crystalline polyester resin, non-crystalline polyester resin, modified polyester resin etc.).

Other binder resin materials than the polyester resin are appropriately selected depending on the intended purpose without any restriction, and examples thereof include a styrene-acryl resin, a polyol resin, a vinyl resin, a polyurethane resin, an epoxy resin, a polyamide resin, a polyimide resin, a silicon-based resin, a phenol resin, a melamine resin, a urea resin, an aniline resin, an iomer resin, and a polycarbonate resin. These may be used independently, or in combination.

<Colorant>

The colorant is appropriately selected from dyes and pigments known in the art without any restriction, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine, iron blue, anthraquinone blue, fast violet B, methylviolet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture thereof. These may be used independently, or in combination.

An amount of the colorant is preferably 1% by mass to 15% by mass, more preferably 3% by mass to 10% by mass, relative to the toner.

The colorant may be used in the form of a master batch in which the colorant forms a composite with a resin. The resin used for production of the master batch or kneaded together with the master batch includes the modified polyester resin, and non-modified polyester resin mentioned above. Other examples of the resin include: styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers); polymethyl methacrylates; polybutyl methacrylates; polyvinyl chlorides; polyvinyl acetates; polyethylenes; polypropylenes; epoxy resins; epoxy polyol resins; polyurethane resins; polyamide resins; polyvinyl butyrals; polyacrylic acid resins; rosin; modified rosin; terpene resins; aliphatic or alicyclic hydrocarbon resins; aromatic petroleum resins; chlorinated paraffin; and paraffin wax. These may be used independently, or in combination.

The master batch can be prepared by mixing or kneading a colorant with the resin for use in the master batch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, for example, a high-shearing disperser (e.g., a three-roll mill) is preferably used.

<Wax>

The wax is appropriately selected depending on the intended purpose without any restriction, and examples thereof include: vegetable wax (e.g. carnauba wax, cotton wax, Japan wax, and rice wax); animal wax (e.g., bees wax and lanolin); mineral wax (e.g., ozokelite and ceresin); and petroleum wax (e.g., paraffin wax, microcrystalline wax and petrolatum).

Examples of the wax other than the natural wax listed above include: synthetic hydrocarbon wax (e.g., Fischer-Tropsch wax and polyethylene wax); and synthetic wax (e.g., ester wax, ketone wax and ether wax).

Further examples include fatty acid amides such as 1,2-hydroxystearic acid amide, stearic amide, phthalic anhydride imide and chlorinated hydrocarbons; low-molecular-weight crystalline polymer resins such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, microcrystalline wax is particularly preferable in view of hot offset resistance, volatile component attributed from the wax during fixing, releasing ability, and low temperature fixing ability.

The melting point of the wax is preferably 50° C. to 120° C.

Since such wax contained in the toner can effectively act as wax at the interface between a fixing roller and the toner, hot offset resistance of the toner can be improved without applying wax, such as oil, to the fixing roller.

An amount of the wax in the toner is appropriately selected depending on the intended purpose without any restriction, but it is preferably 1% by mass to 10% by mass. When the amount of the wax is smaller than 1% by mass, the resulting toner may have poor hot offset resistance. When the amount thereof is greater than 10% by mass, the resulting toner may have poor heat resistance storage stability and poor charging properties.

<Wax Dispersant>

The toner of the present invention preferably contains a wax dispersant together with the wax. Since the toner contains the wax dispersant, dispersibility of the wax in the binder resin improves, and the dispersed state of the wax is easily controlled by selecting the wax for use and adjusting the amount of the wax dispersant. The toner of the present invention contains 50% by mass to 100% by mass of the polyester resin, but the polyester resin and the wax are hardly compatible to each other. If the wax dispersant is not use, the wax may be moved into the aqueous phase without included in toner particles, or the wax may be isolated from the surface of the toner particle. In such a case, the amount of the wax present on surfaces of toner particles increases, which may cause contamination of other members. Accordingly, the wax dispersant is preferably used.

The wax dispersant is appropriately selected depending on the intended purpose without any restriction, but it is preferably a graft polymer having the structure in which a resin (E), which is described later, is grafted as a side chain on a resin (D) that is a principle chain, which is described below.

The resin (D) is not particularly restricted as long as the resin (E) can be grafted thereon, and may be any wax known in the art. Examples thereof include a polyolefin resin, and a thermal degradation-moldable polyolefin resin. Among them, the thermal degradation-moldable polyolefin resin is preferable.

Examples of olefins for forming the polyolefin resin include ethylene, propylene, 1-butene, isobutylene, 1-hexene, 1-dodecene, and 1-octadecene.

Examples of the polyolefin resin include: polymers of olefins; oxides of polymers of olefins; modified products of polymers of olefins; and copolymers of olefins and other monomers capable of copolymerizing with the olefins.

Examples of the polymers of olefins include polyethylene, polypropylene, an ethylene-propylene copolymer, an ethylene-1-butene copolymer, and a propylene-1-hexene copolymer.

Examples of the oxides of polymers of olefins include oxides of the polymer of olefins listed above.

Examples of the modified products of polymers of olefins include maleic acid derivative (e.g. maleic anhydride, monomethyl maleate, monobutyl maleate, and dimethyl maleate) adducts of the polymers of olefins listed above.

Examples of the copolymers of olefins and other monomers capable of copolymerizing with the olefins include copolymers of olefins and monomers such as unsaturated carboxylic acid (e.g., (meth)acrylic acid, itaconic acid, and maleic anhydride), unsaturated carboxylic acid alkyl ester (e.g., alkyl (C1-C18) (meth)acrylate, and alkyl (C1-C18) maleate).

As the polyolefin for use, any polymer can be used as long as the polymer structure thereof includes a polyolefin structure, and monomers for forming the polyolefin do not necessarily include an olefin structure. For example, polymethylene (e.g. Sasol wax) can be used.

Among the polyolefin resins mentioned above, the polymers of olefins, oxides of polymers of olefins, and modified products of polymers of olefins are preferable; polyethylene, polymethylene, polypropylene, ethylene-propylene copolymer, oxidized polyethylene, oxidized polypropylene, and maleic polypropylene are more preferable; and polyethylene and polypropylene are particularly preferable.

Examples of the monomer constituting the resin (E) include: unsaturated alkyl (C1-C5) carboxylates (e.g. methyl (meth)acrylate, ethyl(meth)acrylate, butyl(meth)acrylate, 2-ethylhexyl(meth)acrylate), and vinyl ester-based monomers (e.g. vinyl acetate). Among them, alkyl(meth)acrylate is preferable, and C1-C5 alkyl(meth)acrylate (E1) is more preferable.

As the monomers constituting the resin (E), an aromatic vinyl monomer (E2) is used together with the monomer (E1). Examples of the aromatic vinyl monomer (E2) include styrene-based monomers such as styrene, α-methyl styrene, p-methyl styrene, m-methyl styrene, p-methoxy styrene, p-hydroxy styrene, p-acetoxy styrene, vinyl toluene, ethyl styrene, phenyl styrene, and benzyl styrene. Among them, styrene is particularly preferable.

The mass ratio D/E of the resin D constituting a principle chain of the wax dispersant to the resin E constituting a side chain of the wax dispersant is preferably 1 to 50 in the toner. When the mass ratio D/E is higher than 50, the wax dispersant and the binder resin may have poor compatibility to each other. When the mass ratio D/E is lower than 1, the wax dispersant may not sufficiently become compatible to the wax added, which may cause poor dispersibility of the wax.

The glass transition temperature of the wax dispersant is preferably 55° C. to 80° C., more preferably 55° C. to 70° C. When the glass transition temperature of the wax dispersant is higher than 80° C., the resulting toner may have poor low temperature fixing ability. When the glass transition temperature thereof is lower than 55° C., the resulting toner may have poor hot offset resistance.

An amount of the wax dispersant is preferably 0.01% by mass to 8% by mass, more preferably 0.5% by mass to 6% by mass, relative to the toner. When the amount of the wax is within the preferable range described above, the amount of the wax present on surfaces of toner particles can be appropriately maintained, releasing ability of the toner with a fixing roller or belt is particularly improved, and the resulting toner has excellent smear resistance.

<Other Components>

Other components are appropriately selected depending on the intended purpose without any restriction, and examples thereof include a charge controlling agent, inorganic particles, a flow improving agent, a cleaning improving agent, and a magnetic material.

—Charge Controlling Agent—

The charge controlling agent is appropriately selected depending on the intended purpose without any restriction. Examples of the charge controlling agent include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives.

Specific examples thereof include: BONTRON 03 (nigrosine dye), BONTRON P-51 (quaternary ammonium salt), BONTRON S-34 (metal azo-containing dye), E-82 (oxynaphthoic acid-based metal complex), E-84 (salicylic acid-based metal complex) and E-89 (phenol condensate), all manufactured by ORIENT CHEMICAL INDUSTRIES CO., LTD; TP-302 and TP-415 (quaternary ammonium salt molybdenum complexes) both manufactured by Hodogaya Chemical Co., Ltd.; COPY CHARGE PSY VP 2038 (quaternary ammonium salt), COPY BLUE PR (triphenylmethane derivative), COPY CHARGE NEG VP2036 and COPY CHARGE NX VP434 (quaternary ammonium salts), all manufactured by Hoechst AG; LRA-901 and LR-147 (boron complexes), both manufactured by Japan Carlit Co., Ltd.; copper phthalocyanine; perylene; quinacridone; azo pigments; and polymeric compounds having, as a functional group, a sulfonic acid group, carboxyl group, quaternary ammonium salt, etc.

An amount of the charge controlling agent for use is determined depending on the binder resin for use, presence of optionally used additives, and the production method of the toner including the dispersing method, and thus cannot be determined unconditionally. It is, however, preferably 0.1 parts by mass to 10 parts by mass, more preferably 0.2 parts by mass to 5 parts by mass relative to 100 parts by mass of the binder resin. When the amount of the charge controlling agent is greater than 10 parts by mass, the electrostatic propensity of the resulting toner is excessively large, which reduces the effect of charge controlling agent. As a result, the electrostatic suction force toward the developing roller may increase, which may cause poor flowing ability of the developer, and low image density. The charge controlling agent may be added by dissolving and dispersing after fusing and kneading together with the master batch and the resin, or added by dissolving or dispersing directly in the organic solvent, or added by fixing on a surface of each toner particle after the preparation of the toner particles.

—Inorganic Particles—

The inorganic particles can be used as an external additive for aiding flowing ability, developing ability, and electrostatic propensity of the toner.

The inorganic particles are appropriately selected depending on the intended purpose without any restriction. Examples of the inorganic particles include silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. These may be used independently or in combination.

Other examples of the external additive include polymer particles, such as particles produced by soap-free emulsification polymerization, suspension polymerization, or dispersion polymerization (e.g. polystyrene particles, (meth)acrylic acid ester copolymer particles); polymer particles produced by polymerization condensation such as silicone particles, benzoguanamine particles, and nylon particles; and polymer particles of thermoset resins.

The primary particle diameter of the inorganic particles is preferably 5 nm to 2 μm, more preferably 5 nm to 500 nm. Moreover, the specific surface area of the inorganic particles as determined by the BET method is preferably 20 $m^2/g$ to 500 $m^2/g$.

An amount of the inorganic particles is preferably 0.01% by mass to 5.0% by mass, more preferably 0.01% by mass to 2.0% by mass, relative to the toner.

—Flow Improving Agent—

The flow improving agent is an agent capable of performing a surface treatment on the toner particles to improve hydrophobic properties of the toner so that the degradations of the toner in the flow properties or charging characteristics are prevented in the high humidity environment. Examples of the flow improving agent include a silane coupling agent, a sililating agent, a fluoroalkyl group-containing silane coupling agent, an organic titanate-based coupling agent, an aluminum-based coupling agent, silicone oil, and modified silicone oil.

—Cleaning Improving Agent—

The cleaning improving agent is added to the toner for removing the developer remaining on a photoconductor or a primary transfer member. Examples thereof include: metal salts of fatty acid (e.g. stearic acid), such as zinc stearate, and calcium stearate; polymer particles produced by soap-free emulsification polymerization, such as polymethyl methacrylate particles, and polystyrene particles. The polymer particles preferably have a relatively narrow particle size distribution, particularly preferably the volume average particle diameter of 0.01 μm to 1 μm.

—Magnetic Material—

The magnetic material is appropriately selected from the conventional materials known in the art without any restriction. Examples thereof include iron powder, magnetite powder, and ferrite powder. Among them, a white magnetic material is preferable in terms of the color tone.

Next, the volume average particle diameter, number average particle diameter, acid value, and glass transition temperature of the toner will be explained.

—Volume Average Particle Diameter and Number Average Particle Diameter of Toner—

The volume average particle diameter Dv of the toner is preferably 3 μm to 8 μm, and the ratio Dv/Dn of the volume average particle diameter Dv of the toner to the number average particle diameter Dn of the toner is preferably 1 to 1.25. When the volume average particle diameter Dv of the toner is smaller than 3 μm, the resulting toner may have poor transfer ability. When the volume average particle diameter Dv thereof is greater than 8 μm, the resulting toner may form an image of poor resolution.

When the ratio Dv/Dn is greater than 1.25, the resulting toner may form an image of poor resolution.

The volume average particle diameter Dv and number average particle diameter Dn of the toner can be measured, for example, by a coulter counter method. As a measuring device, for example, Coulter Counter TA-II (manufactured by Beckman Coulter, Inc.), Coulter Multisizer II (manufactured by Beckman Coulter, Inc.) and the like can be used.

—Acid Value of Toner—

The acid value of the toner of the present invention is an important index for the low temperature fixing ability and hot offset resistance of the toner, and is derived from a terminal carboxyl group of an unmodified polyester resin. The acid value of the toner is preferably 0.5 mgKOH/g to 40 mgKOH/g in order to control the low temperature fixing ability (e.g. lowest fixing temperature, and hot offset temperature).

When the acid value is higher than 40 mgKOH/g, the elongation reaction and/or crosslink reaction of the modified polyester resin proceeds insufficiently, and this may result in poor hot offset resistance of the toner. When the acid value thereof is lower than 0.5 mgKOH/g, the effect of the base, which is the improvement of dispersion stability, may not be attained during the production of the toner, or the elongation reaction and/or crosslink reaction of the modified polyester resin tends to be accelerated, which may lower the production stability.

The acid value of the toner can be measured, for example, by the method specified in JIS K0070-1992.

—Glass Transition Temperature of Toner—

Regarding the glass transition temperature of the toner, Tg1st, which is a glass transition temperature of the toner for a first temperature elevation, is preferably 45° C. to 65° C., more preferably 50° C. to 60° C., in view of low temperature fixing ability, heat resistance storage stability and high durability of the toner.

When the glass transition temperature Tg1st of the toner for the first temperature elevation is lower than 45° C., the resulting toner may cause blocking within a developing unit, or cause filming onto a latent electrostatic image bearing member. When Tg1st thereof is higher than 65° C., the resulting toner may have poor low temperature fixing ability.

Tg2nd of the toner, which is a glass transition temperature of the toner for a second temperature elevation, is preferably 20° C. to 40° C.

When the glass transition temperature Tg2nd of the toner for the second temperature elevation is lower than 20° C., the resulting toner may cause blocking within a developing unit, or cause filming onto a latent electrostatic image bearing member. When Tg2nd thereof is higher than 40° C., the resulting toner may have poor low temperature fixing ability.

The glass transition temperature of the toner can be measured by a differential scanning calorimeter (DSC-60, manufactured by Shimadzu Corporation) or the like.

For example, the toner is subjected to a measurement of a DSC curve by means of the aforementioned differential scanning calorimeter. From the obtained DSC curve, the DSC curve corresponding to the first temperature elevation is selected using an analysis program, and a glass transition temperature Tg1st for the first temperature elevation is determined with the endothermic shoulder temperature in the analysis program. Next, the DSC curve corresponding to the second temperature elevation is selected, and a glass transition temperature Tg2nd for the second temperature elevation is determined using the endothermic shoulder temperature.

(Method for Producing Toner)

The method for producing a toner of the present invention is a production method of the toner of the present invention, and includes: allowing an oil phase to react in an aqueous medium to form an emulsified dispersion liquid, where the oil phase is prepared by dissolving or dispersing in an organic solvent a toner material containing at least a compound containing an active hydrogen group, a binder resin precursor containing a site reactive to the compound containing an active hydrogen group, a crystalline polyester resin, a non-crystalline polyester resin, a colorant, wax, and a wax dispersant; adding water to the emulsified dispersion liquid; and removing the organic solvent from the emulsified dispersion.

An amount of the wax dispersant in the oil phase is preferably 30% by mass to 100% by mass, more preferably 35% by mass to 90% by mass, relative to the wax.

When the amount of the wax dispersant is smaller than 30% by mass, an amount of the wax present on surfaces of toner particles increases, and this may cause contamination of other members with the wax. When the amount of the wax dispersant is greater than 100% by mass, the resulting toner may have poor hot offset resistance.

Water is preferably added to the emulsified dispersion liquid (emulsified slurry) in an amount of 5 parts by mass to 40 parts by mass relative to 100 parts by mass of the emulsified dispersion liquid (emulsified slurry).

As the aqueous medium, water may be used alone, or in combination with a solvent miscible with water. Examples of the solvent miscible with water include alcohols (e.g. methanol, isopropanol, and ethylene glycol), dimethylformamide, tetrahydrofuran, cellosolves (e.g. methyl cellosolve), and lower ketones (e.g. acetone, and methyl ethyl ketone).

The binder resin precursor, the colorant, the wax, the wax dispersant, and the like may be added at the time when dispersed elements are formed in the aqueous medium. It is, however, more preferred that these materials be mixed to form a toner material (i.e. a mixture of the materials for forming a toner) and then the toner material be added and dispersed in the aqueous medium. Moreover, the toner material including the binder resin precursor, the colorant, the wax, the wax dispersant, etc. is not necessarily added at the time when particles are formed in the aqueous medium, and may be added after particles are formed. For example, the colorant is added in the conventional dying method after forming particles without including the colorant.

The dispersion method is appropriately selected depending on the intended purpose without any restriction, and examples thereof include conventional dispersers such as a low-speed shearing disperser, a high-speed shearing disperser, a friction disperser, a high-pressure jetting disperser and ultrasonic wave disperser. Among them, the high-speed shearing disperser is preferable for giving dispersed elements of 2 μm to 20 μm in the diameter.

In use of the high-speed shearing disperser, the rotating speed is appropriately selected depending on the intended purpose without any restriction, but is preferably 1,000 rpm to 30,000 rpm, more preferably 5,000 rpm to 20,000 rpm. The duration for dispersing is appropriately selected depending on the intended purpose without any restriction, but in the case of the batch system, it is preferably 0.1 minutes to 60 minutes. The temperature during the dispersing is preferably 0° C. to 80° C. (in a pressurized state), more preferably 10° C. to 40° C.

An amount of the aqueous medium is preferably 100 parts by mass to 1,000 parts by mass relative to 100 parts by mass of the toner material. When the amount of the aqueous medium is smaller than 100 parts by mass, the toner material may not be in a desirable dispersed state, and thus toner particles of the predetermined particle diameters may not be obtained. When the amount thereof is greater than 1,000 parts by mass, it is not economically desirable. Moreover, a dispersant is optionally used for the dispersing. Use of the dispersant is preferable as a sharp particle size distribution of the dispersed particles can be attained, and the dispersed state is stably maintained.

As a method for reacting the binder resin precursor (polyester prepolymer) and the compound containing an active hydrogen group, the compound containing an active hydrogen group may be added and reacted before the toner material is dispersed in the aqueous medium. Alternatively, the compound containing an active hydrogen may be added after the toner material is dispersed in the aqueous medium to thereby initiate the reaction from an interface of a particle. In the latter case, the modified polyester with the polyester prepolymer is preferentially generated on a surface of a toner base particle to be formed, so that it is possible to give a concentration deviation within the particle.

A dispersant used for dispersing the oil phase containing the toner material in the aqueous medium containing water include; anionic surfactants such as alkylbenzenesulfonic acid salts, α-olefin sulfonic acid salts and phosphoric acid esters; cationic surfactants such as amine salts (e.g., alkyl amine salts, amino alcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi (aminoethyl)glycine, di(octylaminoethyl)glycine and N-alkyl-N,N-dimethylammonium betaine.

Also, a fluoroalkyl group-containing surfactant can exhibit its dispersing effects even in a small amount. Preferable examples of the fluoroalkyl group-containing anionic surfactant include fluoroalkyl carboxylic acid having 2 to 10 carbon atoms and metal salts thereof, disodium perfluorooctanesulfonylglutamate, sodium 3-[ω-fluoroalkyl(C6-C11)oxy)-1-alkyl(C3-C4) sulfonate, sodium 3-[ω-fluoroalkanoyl(C6-C8)-N-ethylamino]-1-propanesulfonate, fluoroalkyl(C11-C20) carboxylic acid and metal salts thereof, perfluoroalkylcarboxylic acid(C7-C13) and metal salts thereof, perfluoroalkyl(C4-C12)sulfonate and metal salts thereof, perfluorooctanesulfonic acid diethanol amide, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin and monoperfluoroalkyl(C6-C16) ethylphosphate.

Examples of the commercial product of the fluoroalkyl group-containing anionic surfactant include: SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of Dainippon Ink and Chemicals, Inc.); EFTOP EF-102, 103, 104, 105, 112, 123A, 123B, 306A, 501, 201 and 204 (these products are of Tohchem Products Co., Ltd.); and FUTARGENT F-100 and F150 (these products are of NEOS COMPANY LIMITED).

Examples of the fluoroalkyl group-containing cationic surfactant include fluoroalkyl group-containing primary, secondary or tertiary aliphatic compounds, aliphatic quaternary ammonium salts (e.g., perfluoroalkyl (C6-C10) sulfonamide propyltrimethylammonium salts), benzalkonium salts, benzetonium chloride, pyridinium salts and imidazolinium salts, and product names thereof are: SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of Dainippon Ink and Chemicals, Inc.); EFTOP EF-132 (product of Tohchem Products Co., Ltd.); and FUTARGENT F-300 (product of Neos COMPANY LIMITED).

Moreover, poorly water-soluble inorganic dispersing agents, such as tricalcium phosphate, calcium carbonate, titanium oxide, colloidal silica, and hydroxyapatite, can also used as the dispersant.

Furthermore, a polymeric protective colloid or water-insoluble organic particles may be used to stabilize dispersed droplets. Examples of the water-insoluble organic particles include: acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetone acrylamide and methylol compounds of thereof; acid chlorides (e.g., acrylic acid chloride and methacrylic acid chloride); nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

When an acid- or alkali-soluble compound (e.g., calcium phosphate) is used as a dispersion stabilizer, it is preferred that the calcium phosphate used be dissolved with an acid (e.g., hydrochloric acid), followed by washing with water, to thereby remove it from the formed fine particles (toner particles). Also, the calcium phosphate may be removed through enzymatic decomposition.

Alternatively, the dispersing agent used may remain on the surfaces of the toner particles. But, the dispersing agent is preferably removed through washing in terms of charging ability of the formed toner.

Furthermore, in order to decrease the viscosity of the toner material, there can be used a solvent in which a modified polyester obtained through reaction of polyester prepolymers can be dissolved. Use of the solvent is preferred from the viewpoint of attaining a sharp particle size distribution. The solvent used is preferably a volatile solvent having a boiling point lower than 100° C., since solvent removal can be easily performed. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used independently, or in combination. Among them, the aromatic solvents such as toluene and xylene, and the halogenated hydrocarbons such as methylene chloride, 1,2-dichloroethane, chloroform, and carbon tetrachloride are preferable.

An amount of the solvent to 100 parts by mass of the polyester prepolymer is preferably 300 parts by mass or smaller, more preferably 100 parts by mass or smaller, and even more preferably 25 parts by mass to 70 parts by mass. When the solvent is used, the solvent is preferably removed by heating under the normal pressure or reduced pressure, after the elongation and/or crosslink reaction.

The duration for the elongation and/or crosslink reaction is appropriately adjusted depending on the reactivity owing to the combination of the polyester prepolymer and the compound containing an active hydrogen group, but it is preferably 10 minutes to 40 hours, more preferably 30 minutes to 24 hours. The reaction temperature is preferably 0° C. to 100° C., more preferably 10° C. to 50° C. Moreover, a conventional catalyst may be used, if necessary. Specific examples of the catalyst include: tertiary amine such as triethyl amine; and imidazole.

The organic solvent is removed from the obtained dispersion liquid (emulsified slurry). Examples of the method for removing the organic solvent include: (1) a method in which the entire liquid is gradually heated to completely evaporate and remove the organic solvent contained in the dispersed droplets; and (2) a method in which the emulsified dispersion liquid is sprayed in a dry atmosphere to completely evaporate and remove the water-insoluble organic solvent in the droplets to thereby form toner particles, at the same time as evaporating and removing the aqueous dispersant.

As for the dry atmosphere in which the emulsified dispersion liquid is sprayed, heated gas (e.g., air, nitrogen, carbon dioxide and combustion gas), especially, gas flow heated to a temperature equal to or higher than the highest boiling point among the solvents used, is generally used. By removing the organic solvent in a short time using, for example, a spray dryer, a belt dryer or a rotary kiln, the resulting product has satisfactory quality.

After removing the organic solvent, toner particles are formed. The toner particles can be subjected to washing, drying, and the like. Then, the toner is optionally subjected to classification, or the like. Classification is performed by removing very fine particles using a cyclone, a decanter, a centrifugal separator, etc. in the liquid. Needless to say, classification may be performed on powder obtained after drying.

The obtained toner particles after drying may be mixed with other particles such as wax particles, charge controlling agent particles, flow improving agent particles, and colorant fine particles, and also a mechanical impact may be applied to the mixture of the particles for immobilization or fusion of other particles on the surfaces of the toner particles, to thereby prevent the other particles from dropping off from the surfaces of the composite particles (the toner particles on each surface of which other particles have been fixed).

Specific examples of the method for mixing or applying a mechanical impact include a method in which an impact is applied to a mixture using a high-speed rotating blade, and a method in which an impact is applied by putting mixed particles into a high-speed air flow and accelerating the air speed so that the particles collide against one another or that the particles are crashed into a proper collision plate. Examples of apparatuses used in these methods include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

(Developer)

The developer of the present invention contains at least the toner of the present invention, and may further contain appropriately selected other components, such as a carrier. The developer may be a one-component developer, or two-component developer, but is preferably the two-component developer in view of its long service life or the like when used in a high-speed printer and the like corresponding to the recent increased speed in information processing.

When the developer of the present invention is used as a one-component developer, a change in the particle diameters of the toner is small even after supplying the toner to compensate the consumed amount, filming of the toner to the developing roller and fusion of the toner to members such as a blade for forming the mass of the toner into a thin layer can be prevented, and desirable and stable developing properties can be attained over a long period of use (stirring) in a developing device. When the developer of the present invention is used as a two-component developer, a change in the particle diameters of the toner is small even after supplying the toner to compensate the consumed amount over a long period of time, and desirable and stable developing properties can be attained even after stirring the developer for a long period of time in a developing device.

—Carrier—

The carrier is appropriately selected depending on the intended purpose without any restriction, but the carrier preferably contains a core and a resin layer coating the core.

The material of the core is appropriately selected from the conventional materials known in the art, and is preferably, for example, selected from a manganese-strontium (Mn—Sr) based material of 50 emu/g to 90 emu/g, a manganese-magnesium (Mn—Mg) based material of 50 emu/g to 90 emu/g. In order to attain secure a sufficient image density, use of a high magnetic material, such as iron powder (100 emu/g or higher) and magnetite (75 emu/g to 120 emu/g), is preferable. Moreover, a weak magnetic material such as a cupper-zinc (Cu—Zn) based material (30 emu/g to 80 emu/g) is preferable because the resulting carrier enables to reduce the impact of the toner brush onto a photoconductor, and therefore it is advantageous for forming high quality images. These may be used independently, or in combination.

The volume average particle diameter of the core is preferably 10 μm to 150 μm, more preferably 40 μm to 100 μm. When the average particle diameter (volume average particle diameter ($D_{50}$)) of the core is smaller than 10 μm, the proportion of the fine particles in the particle size distribution of the carrier increases, and therefore the magnetization per carrier particle is small, which may cause scattering of the carrier. When the average particle diameter thereof is larger than 150 μm, the specific area of the resulting particle of the carrier is small, which may cause scattering of the carrier. Use of the core of the size as mentioned may lower the reproducibility of an image especially in a solid imaging part, when a full color image having a large area of the solid image part is printed.

The material of the resin layer is appropriately selected depending on the intended purpose without any restriction. Examples thereof include an amino-based resin, a polyvinyl-based resin, a polystyrene-based resin, a halogenated olefin resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer (e.g. a terpolymer of tetrafluoroethylene, vinylidene fluoride, and non-fluoride monomer), and a silicone resin. These may be used independently, or in combination.

Examples of the amino-based resin include a urea-formaldehyde resin, a melamine resin, a benzoguanamine resin, a urea resin, a polyamide resin, and an epoxy resin. Examples of the polyvinyl-based resin include an acryl resin, polymethyl methacrylate, polyacrylonitrile, polyvinyl acetate, polyvinyl alcohol and polyvinyl butyral. Examples of the polystyrene-based resin include polystyrene, and a styrene-acryl copolymer. Examples of the halogenated olefin resin include polyvinyl chloride. Examples of the polyester-based resin include polyethylene terephthalate, and polybutylene terephthalate.

Moreover, the resin layer may contain conductive powder, if necessary. Examples of the material of the conductive powder include metal, carbon black, titanium oxide, tin oxide and zinc oxide. The average particle diameter of the conductive powder is preferably 1 μm or smaller. When the average particle diameter thereof is larger than 1 μm, it may be difficult to control the electric resistance.

The resin layer can be formed, for example, by preparing a coating liquid by dissolving a silicone resin or the like in a solvent, applying the coating liquid onto the surface of the core by the conventional coating method, drying and baking the coating liquid. Examples of the coating method include dip coating, spray coating, and brush coating.

The solvent is appropriately selected depending on the intended purpose without any restriction, and examples thereof include toluene, xylene, methyl ethyl ketone, methyl isobutyl ketone, cellosolve, and butyl acetate.

The baking method is not particularly restricted, and may be of external heating or internal heating. Examples of the baking method include methods using a fixed-type electric furnace, a flow-type electric furnace, a rotary electric furnace, a burner furnace, or micro waves.

An amount of the resin layer in the carrier is preferably 0.01% by mass to 5.0% by mass. When the amount of the resin layer is smaller than 0.01% by mass, a uniform resin layer may not be formed on a surface of the core particle. When the amount thereof is greater than 5.0% by mass, a thickness of the resulting resin layer is excessively thick so that the resulting carrier may cause aggregations so that uniform carrier particles may not be obtained.

In the case where the developer is a two-component developer, an amount of the carrier in the two-component developer is appropriately selected without any restriction. For example, the amount of the carrier is preferably 90% by mass to 98% by mass, more preferably 93% by mass to 97% by mass.

(Image Forming Method)

The image forming method of the present invention contains a latent electrostatic image forming step, a developing step, a transferring step, and a fixing step, and may further contain other steps, if necessary.

—Latent Electrostatic Image Forming Step—

The latent electrostatic image forming step is forming a latent electrostatic image on a latent electrostatic image bearing member.

The material, shape, structure, size, and the like of the latent electrostatic image bearing member are appropriately selected from those known in the art without any restriction, but the shape thereof is preferably a drum shape. Examples of the material thereof include e: an inorganic photoconductor such as amorphous silicon, and selenium; and an organic photoconductor such as polysilane, and phthalopolymethine. Among them, the amorphous silicon photoconductor is preferable as it has a long service life.

A latent electrostatic image can be formed, for example, by uniformly charging the surface of the latent electrostatic image bearing member, and exposing the charged surface of the latent electrostatic image bearing member to light imagewise, and the latent electrostatic image can be formed by using the latent electrostatic image forming unit.

The latent electrostatic image forming unit contains, for example, at least a charging unit configured to apply a voltage to the surface of the latent electrostatic image bearing member to uniformly charge the surface of the latent electrostatic image bearing member, and an exposing unit configured to expose the surface of the latent electrostatic image bearing member to light imagewise.

The charging of the latent electrostatic image bearing member can be performed, for example, by applying voltage on a surface of the latent electrostatic image bearing member using the charging unit.

The charging unit is appropriately selected depending on the intended purpose without any restriction, and examples thereof include conventional contact chargers known in the art equipped with conductive or semiconductive roller, brush, film, rubber blade, or the like, and conventional non-contact charger using corona discharge such as corotron and scorotron.

The exposing can be performed, for example, by exposing the surface of the latent electrostatic image bearing member to light imagewise using the exposing unit.

The exposing unit is not particularly restricted, as long as it is capable of exposing the charged surface of the latent electrostatic image bearing member by the charging unit to light imagewise, and examples thereof include various exposing devices such as a reproduction optical exposing device, a rod-lens array exposing device, a laser optical exposure device, and a liquid crystal shutter optical device.

—Developing Step—

The developing step is developing the latent electrostatic image with the toner and/or developer of the present invention to form a visible image.

The formation of the visible image can be performed, for example, by developing the latent electrostatic image with the toner and/or developer of the present invention by means of the developing unit.

The developing unit is not particularly restricted, and can be appropriately selected from the conventional developing units, as long as it is capable of performing development using the toner and/or developer of the present invention. For example, a developing unit having at least a developing device housing the toner and/or developer of the present invention, and capable of applying the toner and/or developer to the latent electrostatic image in a contact or non-contact manner is preferably used.

The developing device may be employ a dry developing system, or wet developing system, and may be a developing device for a singly color, or a developing device for a multicolor. Preferable examples of the developing device include a device having a stirrer configured to charge the toner and/or developer of the present invention by frictions from stirring, and a rotatable magnetic roller.

In the developing device, for example, the toner and the carrier are mixed and stirred, and the toner is charged by the friction from the stirring. The charged toner is held on the surface of the rotatable magnetic roller in the form of a brush to form a magnetic brush. The magnetic roller is provided adjacent to the latent electrostatic image bearing member, part of the toner forming the magnetic brush on the surface of the magnetic roller is moved to the surface of the latent electrostatic image bearing member by electrical attraction force. As a result, the latent electrostatic image is developer with the toner to form a visible image on the surface of the latent electrostatic image bearing member.

Note that, the developer housed in the developing device is the developer containing the toner of the present invention, but the developer may be a one-component developer or two-component developer. The developer for use is preferably a two-component developer, and in this case, a toner contained in the developer is the toner of the present invention.

—Transferring Step—

The transferring step is transferring the visible image to a recording medium. In the preferred embodiment, the transferring step uses an intermediate transfer member, and includes primary transferring the visible image onto the intermediate transfer member, and secondary transferring the visible image onto a recording medium. In the more preferred embodiment, the transferring step includes a primary transferring step and a secondary transferring step where the primary transferring step is transferring visible images, which have been formed with the toners of two or more colors, preferably full color, are respectively transferred to an intermediate transfer member to form a composite transfer image, and the secondary transferring step is transferring the composite transfer image formed on the intermediate transfer member to a recording medium.

The transferring can be performed, for example, by charging the latent electrostatic image bearing member, on which the visible image has been formed, by means of a transfer charging device, and this can be performed by the transferring unit. The transferring unit preferably contains a primary transferring unit configured to transfer the visible image onto an intermediate transfer member to form a composite transfer image, and a secondary transferring unit configured to transfer the composite transfer image onto a recording medium.

The intermediate transfer member is appropriately selected from conventional transfer members depending on the intended purpose without any restriction, and preferable examples thereof include a transfer belt.

The transferring unit (the primary transferring unit, the secondary transferring unit) preferably contains at least a transfer instrument configured to charge the visible image formed on the latent electrostatic image bearing member (e.g. the photoconductor) to release the visible image from the photoconductor to the side of the recording medium. The number of the transfer instruments equipped may be 1, or 2 or more.

Examples of the transferring instrument include a corona transfer device utilizing corona discharge, a transfer belt, a transfer roller, a pressure transfer roller, and an adhesion transfer member.

The recording medium is appropriately selected from conventional recording media (recording paper) known in the art without any restriction.

—Fixing Step—

The fixing step is fixing the visible image transferred onto the recording medium. In this step, fixing may be performed every time when an image formed of the toner of each color is transferred onto the recording medium. Alternatively, fixing may be performed after the toners of all the colors are transferred to the recording medium in a laminated state.

The fixing unit is appropriately selected depending on the intended purpose without any restriction, but it is suitably selected from conventional heating pressurizing units. Examples of the heating and pressurizing unit include a combination of a heating roller and a pressure roller, and a combination of a heating roller, a pressure roller, and an endless belt.

Generally, the heating temperature by the heating pressurizing unit is generally 80° C. to 200° C.

—Other Steps—

Examples of other steps include a diselectrification step, a cleaning step, a recycling step, and a controlling step.

The diselectrification step is applying diselectrification bias to the latent electrostatic image bearing member to diselectrify the latent electrostatic image bearing member, and the diselectrification step can be suitably performed by a diselectrification unit.

The diselectrification unit is appropriately selected from conventional diselectrification units known in the art without any restriction, provided that it is capable of applying diselectrification bias to the latent electrostatic image bearing member. Preferable examples thereof include a diselectrification lamp.

The cleaning step is removing the residual toner on the latent electrostatic image bearing member, and the cleaning step can be suitably performed by a cleaning unit.

The cleaning unit is appropriately selected from cleaners known in the art without any restriction, provided that it is capable of removing the toner remained on the latent electrostatic image bearing member. Preferable examples thereof include a magnetic brush cleaner, an electrostatic brush cleaner, a magnetic roller cleaner, a blade cleaner, a brush cleaner, and a web cleaner.

The recycling step is recycling the toner removed in the cleaning step to the developing unit, and the recycling can be suitably performed by a recycling unit.

The recycling unit is not particularly restricted, and examples thereof include conventional conveying units.

The controlling step is controlling operations of each step, and can be suitably performed by a controlling unit.

The controlling unit is appropriately selected depending on the intended purpose without any restriction, provided that it is capable of controlling the operations of each step. Examples thereof include devices such as a sequencer, and a computer.

The image forming method of the present invention uses the toner having high transfer efficiency without causing retransferring, and excellent low temperature fixing ability, and capable of forming high quality images. Therefore, the image forming method of the present invention can form high quality images efficiently.

EXAMPLES

Examples of the present invention will be explained hereinafter, but these examples shall not be construed as to limit the scope of the present invention in any way.

In Examples below, an acid value, hydroxyl value, melting point, glass transition temperature, volume average molecular weight, and number average molecular weight of resins such as a crystalline polyester resin, non-crystalline polyester resin, and polyester prepolymer were measured in the following manners.

<Measurement of Acid Value>

An acid value was measured in accordance with the measuring method described in JIS K0070-1992 under the conditions described below.

Firstly, 0.5 g of a sample (0.3 g of an ethyl acetate soluble component) was added to 120 mL of toluene, and the mixture was stirred for about 10 hours at room temperature (23° C.), to thereby dissolve the sample therein. To this, 30 mL of ethanol was further added to thereby prepare a sample solution.

Then, an acid value of the sample was measured at 23° C. by means of a potentiometric automatic titrator DL-53 (product of Mettler-Toledo K.K.) and an electrode DG113-SC (product of Mettler-Toledo K.K.), and the result was analyzed using an analysis software LabX Light Version 1.00.000.

Note that, a mixed solvent of 120 mL of toluene and 30 mL of ethanol was used for the device. A hydroxyl value of the sample was measured under the same conditions.

The measurement of the acid value was performed and calculated the method described above, but specifically, it was calculated a s follows. The sample solution was titrated with a pre-standardized 0.1N potassium hydroxide/alcohol solution and then the acid value w as calculated from the titration value based on the following formula:

Acid value[KOHmg/g]=titration value[mL]×$N$×56.1 [mg/mL]/mass of sample[g]($N$ is a factor of 0.1N potassium hydroxide/alcohol solution).

<Measurement of Hydroxyl Value>

A hydroxyl value was measured in accordance with the measuring method described in JIS K0070-1966 under the following conditions.

Specifically, at first, 0.5 g of a sample was accurately weighed in a 100 mL measuring flask, and then 5 mL of an acetylation reagent was added thereto. Next, the measuring flask was heated for 1 hour to 2 hours in a hot water bath set to 100° C.±5° C., and was then taken out from the hot water bath and left to cool. Thereafter, water was added to the measuring flask, which was then shaken to decompose acetic anhydride. Next, for completely decomposing acetic anhydride, the flask was heated again in the hot water bath for 10 minutes or longer and then left to cool. Thereafter, the wall of the flask was thoroughly washed with an organic solvent. The resulting solution was subjected potentiometric titration with N/2 potassium hydroxide ethyl alcohol solution using the electrode to thereby determine a hydroxyl value.

<Measurements of Melting Point and Glass Transition Temperature>

A melting point and glass transition temperature of the resin were measured by means of a DSC system (a differential scanning calorimeter) (DSC-60, manufactured by Shimadzu Corporation) in the following manner.

Firstly, about 5.0 mg of a sample was added to an aluminum sample container. The sample container was placed on a holder unit, and set in an electric furnace. Next, in a nitrogen atmosphere, the sample was heated from 0° C. to 150° C. at a temperature increasing rate of 10° C./min. Then, the sample was cooled from 150° C. to 0° C. at a temperature decreasing rate of 10° C./min, followed by heating to 150° C. at the temperature increasing rate of 10° C./min, to thereby measure a DSC curve by means of a differential scanning calorimeter (DSC-60, manufactured by Shimadzu Corporation).

Using an analysis program in the DSC-60 system, a DSC curve corresponding to the first temperature elevation was selected from the obtained DSC curve, and a glass transition temperature Tg1st of the sample for the first temperature elevation was determined using "endothermic shoulder temperature" in the analysis program. Next, the DSC curve corresponding to the second temperature elevation was selected, and a glass transition temperature Tg2nd of the sample for the second temperature elevation was determined using "endothermic shoulder temperature".

From the obtained DSC curve, the DSC curve corresponding to the first temperature elevation was selected using the analysis program in the DSC-60 system and a melting point of the sample for the first temperature elevation was determined using "endothermic peak temperature" in the analysis program, and the DSC curve corresponding to the second temperature elevation was selected using the analysis program, and a melting point of the sample for the second temperature elevation was determined using the "endothermic peak temperature".

—Measurement of Molecular Weight of Crystalline Polyester Resin—

<Measurements of Volume Average Molecular Weight and Number Average Molecular Weight>

(Measurement of Molecular Weight by GPC using o-Dichloribenzene as Solvent)

A column was stabilized in a heat chamber set to 145° C., and to the column of this temperature, an eluting solution (o-dichlorobenzene containing 0.3% by mass of BHT) was pored at a flow rate of 1 mL/min, and 50 μL to 200 μL of the o-dichlorobenzene solution prepared to have a sample concentration of 0.3% by mass of the resin and to have a temperature of 140° C. was poured to perform a measurement.

As a measuring device, 150CV of Nihon Waters K.K. was used, and as a column, Shodex AT-G+AT-806MS (2 columns) was used. For the measurement of the molecular weight of the sample (the toner), the molecular weight distribution of the sample was calculated from the relationship between logarithmic values of the calibration curve prepared by a several monodispersible polystyrene standard samples, and the count number. The slice width was 0.05 seconds.

As for the standard polystyrene samples for obtaining the calibration curve, TSK-GEL standard material "PS-polymer kit" (of Tosoh Corporation) was used. Moreover, a refractive index (RI) detector was used as the detector.

—Measurement of Molecular Weight of Non-Crystalline Polyester Resin—

<Measurements of Weight Average Molecular Weight and Number Average Molecular Weight>

The weight average molecular weight and number average molecular weight were measured in the following manner.

Gel permeation chromatography (GPC) measuring device: GPC-8220GPC (Tosoh Corporation)

Column: TSKgel SuperHZM-H, 15 cm, three connected columns (Tosoh Corporation)

Temperature: 40° C.

Solvent: tetrahydrofuran (THF)

Flow rate: 0.35 mL/min

Sample: 0.4 mL of a 0.15% sample to be supplied

Pretreatment of sample: The sample was dissolved in tetrahydrofuran (THF containing a stabilizer, manufactured by Wako Chemical Industries, Ltd.) to give a concentration of 0.15% by mass, the resulting solution was then filtered through a filter having a pore size of 0.2 μm, and the filtrate from the filtration was used as a sample. The measurement was performed by supplying 100 μL of the tetrahydrofuran (THF) sample solution.

For the measurement of the volume average molecular weight Mw, number average molecular weight Mn of the crystalline polyester resin, the molecular weight distribution of the sample was calculated from the relationship between the logarithmic value of the calibration curve prepared from a several monodispersible polystyrene standard samples and the number of counts. As the standard polystyrene samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene were used. As the detector, a refractive index (RI) detector was used.

(Synthesis Example 1 of Crystalline Polyester Resin)

A 5 L four-neck flask equipped with a nitrogen-introducing pipe, a drainpipe, a stirrer and a thermocouple was charged with 2,500 g of 1,12-decanediol, 2,330 g of 1,8-octanedioic acid, and 4.9 g of hydroquinone, and the mixture was allowed to for 20 hours at 180° C., then for 6 hours at 200° C., followed by reacting for 10 hours at 8.3 kPa to thereby synthesize Crystalline Polyester Resin 1. The melting point, molecular weight distribution, acid value, and hydroxyl value of Crystalline Polyester Resin 1 are presented in Table 1.

(Synthesis Example 2 of Crystalline Polyester Resin)

A 5 L four-neck flask equipped with a nitrogen-introducing pipe, a drainpipe, a stirrer and a thermocouple was charged with 2,500 g of 1,12-decanediol, 2,330 g of 1,8-octanedioic acid, and 2.9 g of hydroquinone, and the mixture was allowed to for 28 hours at 190° C., then for 11 hours at 200° C., followed by reacting for 16 hours at 8.5 kPa to thereby synthesize Crystalline Polyester Resin 2. The melting point, molecular weight distribution, acid value, and hydroxyl value of Crystalline Polyester Resin 2 are presented in Table 1.

(Synthesis Example 3 of Crystalline Polyester Resin)

A 5 L four-neck flask equipped with a nitrogen-introducing pipe, a drainpipe, a stirrer and a thermocouple was charged with 2,500 g of 1,12-decanediol, 2,330 g of 1,8-octanedioic acid, and 6.9 g of hydroquinone, and the mixture was allowed to for 11 hours at 190° C., then for 5 hours at 200° C., followed by reacting for 4 hours at 8.5 kPa to thereby synthesize Crystalline Polyester Resin 3. The melting point, molecular weight distribution, acid value, and hydroxyl value of Crystalline Polyester Resin 3 are presented in Table 1.

(Synthesis Example 4 of Crystalline Polyester Resin)

A 5 L four-neck flask equipped with a nitrogen-introducing pipe, a drainpipe, a stirrer and a thermocouple was charged with 2,500 g of 1,12-decanediol, 2,330 g of 1,8-octanedioic acid, and 8.9 g of hydroquinone, and the mixture was allowed to for 5 hours at 170° C., then for 4 hours at 200° C., followed by reacting for 3 hours at 8.5 kPa to thereby synthesize Crystalline Polyester Resin 4. The melting point, molecular weight distribution, acid value, and hydroxyl value of Crystalline Polyester Resin 4 are presented in Table 1.

TABLE 1

| | Melting point (° C.) | Acid value (mgKOH/g) | Hydroxyl value (mgKOH/g) | Mw | Mn | Mw/Mn | Number molecular weight | |
|---|---|---|---|---|---|---|---|---|
| | | | | | | | Proportion of 500 or smaller (%) | Proportion of 1,000 or smaller (%) |
| Crystalline Polyester Resin 1 | 70 | 25 | 2.5 | 15,000 | 4,400 | 3.4 | 1.6 | 3.6 |
| Crystalline Polyester Resin 2 | 73 | 21 | 1.9 | 19,800 | 4,800 | 4.1 | 1.4 | 3.1 |
| Crystalline Polyester Resin 3 | 69 | 25 | 2.8 | 6,100 | 1,450 | 4.2 | 1.9 | 3.8 |
| Crystalline Polyester Resin 4 | 59 | 33 | 5.1 | 4,700 | 1,100 | 4.3 | 3.6 | 6.1 |

(Synthesis Example of Wax Dispersant)

An autoclave reaction vessel equipped with a thermometer and a stirrer was charged with 600 parts by mass of xylene, and 300 parts by mass of low molecular weight polyethylene (SANWAX LEL-400, softening point of 128° C., manufactured by Sanyo Chemical Industries, Ltd.), and the polyethylene was sufficiently dissolved therein. After replacing the inner atmosphere of the reaction vessel with nitrogen gas, a mixed solution including 2,310 parts by mass of styrene, 270 parts by mass of acrylonitrile, 150 parts by mass of butyl acrylate, 78 parts by mass of di-t-butylperoxyhexahydroterephthalate, and 455 parts by mass of xylene was added into the reaction vessel dropwise over 3 hours at 175° C., to thereby proceed polymerization, and the temperature thereof was maintained at 175° C. for 30 minutes. Subsequentially, the solvent was removed from the reaction solution to thereby synthesize a wax dispersant.

(Synthesis Example of Non-Crystalline Polyester (Low Molecular Weight Polyester) Resin)

A 5 L four-neck flask equipped with a nitrogen-introducing pipe, a drainpipe, a stirrer and a thermocouple was charged with 229 parts by mass of bisphenol A ethylene oxide 2 mol adduct, 529 parts by mass of bisphenol A propylene oxide 3 mol adduct, 100 parts by mass of isophthalic acid, 108 parts by mass of terephthalic acid, 46 parts by mass of adipic acid and 2 parts by mass of dibutyl tin oxide. The mixture was allowed to react for 10 hours at 230° C. under normal pressure, and further reacted for another 5 hours under reduced pressure of 10 mmHg to 15 mmHg. After the reaction, 30 parts by mass of trimellitic anhydride was added to the reaction vessel, and the mixture was allowed to react for 3 hours at 180° C. under normal pressure to thereby synthesize a non-crystalline polyester resin.

The obtained non-crystalline polyester resin had the number average molecular weight Mn of 1,800, weight average molecular weight Mw of 5,500, glass transition temperature of 50° C., and acid value of 20 mgKOH/g.

(Synthesis Example of Polyester Prepolymer)

A reaction vessel equipped with a condenser, a stirrer and a nitrogen-introducing pipe was charged with 682 parts by mass of bisphenol A ethylene oxide 2 mol adduct, 81 parts by mass of bisphenol A propylene oxide 2 mol adduct, 283 parts by mass of terephthalic acid, 22 parts by mass of trimellitic anhydride and 2 parts by mass of dibutyl tin oxide. The resultant mixture was allowed to react for 8 hours at 230° C. under normal pressure and further react for 5 hours at a reduced pressure of 10 mmHg to 15 mmHg, to thereby synthesize intermediate polyester.

The obtained intermediate polyester had the number average molecular weight Mn of 2,100, weight average molecular weight Mw of 9,500, glass transition temperature of 55° C., acid value of 0.5 mgKOH/g, and hydroxyl value of 51 mgKOH/g.

Next, a reaction vessel equipped with a condenser, a stirrer and a nitrogen-introducing pipe was charged with 410 parts by mass of the synthesized intermediate polyester, 89 parts by mass of isophorone diisocyanate and 500 parts by mass of ethyl acetate, and the mixture was allowed to react for 5 hours at 100° C., to thereby synthesize polyester prepolymer. The amount of free isocyanate contained in the polyester prepolymer was 1.53% by mass.

(Synthesis Example of Ketimine)

A reaction vessel equipped with a stirring rod and a thermometer was charged with 170 parts by mass of isophorone diisocyanate and 75 parts by mass of methyl ethyl ketone, and the mixture was allowed to react for 5 hours at 50° C., to thereby synthesize a ketimine compound. The amine value of the ketimine compound was 418.

(Production Example of Master Batch (MB))

Water (1,200 parts by mass), carbon black (Printex 35, product of Degussa) [DBP oil absorption amount=42 mL/100 mg, pH=9.5] (540 parts) and the synthesized noncrystalline polyester resin (1,200 parts by mass) were mixed together with HENSCHEL MIXER (product of Mitsui Mining Co., Ltd). The resulting mixture was kneaded for 30 minutes at 150° C. with a two-roll mill, and then rolled, cooled and pulverized with a pulverizer, to thereby produce a master batch.

Example 1

Production of Toner

—Preparation of Oil Phase—

A vessel equipped with a stirring rod and a thermometer was charged with 378 parts by mass of the synthesized noncrystalline polyester resin, 110 parts by mass of microcrystalline wax (Be Square 180 White, TOYO ADL CORPORATION), 77 parts by mass of the synthesized wax dispersant (70% by mass of the wax dispersant relative to the amount of the wax), 22 parts by mass of a charge controlling agent (CCA) (salicylic acid metal complex E-84, manufactured by Orient Chemical Industries, Ltd.) and 947 parts by mass of ethyl acetate, and the mixture was heated to 80° C. with stirring. The resulting mixture was maintained its temperature at 80° C. for 5 hours and then cooled to 30° C. over 1 hour. Subsequently, the vessel was charged with 500 parts by mass of the master batch obtained in Production Example 1 and 500 parts by mass of ethyl acetate, followed by mixing the mixture for 1 hour, to thereby prepare a raw material solution.

The obtained raw material solution (1,324 parts by mass) was poured into a vessel, and the carbon black and wax were dispersed with a bead mill (ULTRA VISCOMILL, manufactured by AIMEX CO., Ltd.) under the following conditions: a liquid feed rate of 1 kg/hr, disc circumferential velocity of 6 m/s, 0.5 mm-zirconium beads packed to 80% by volume, and 3 passes. Next, a 65% by mass ethyl acetate solution of the non-crystalline polyester resin (1,042.3 parts by mass) was added thereto, and passed once with the bead mill under the above conditions, to thereby obtain a pigment-wax dispersion liquid. The solids content of the pigment-wax dispersion liquid was 50% by mass.

—Preparation of Crystalline Polyester Dispersion Liquid 1—

A 2 L-metal container was charged with 100 g of Crystalline Polyester Resin 1, and 400 g of ethyl acetate, and the mixture was heated at 75° C. to dissolve Crystalline Polyester Resin 1 therein, followed by quenching the resulting solution in an ice-water bath at the rate of 27° C./min. To this, 500 mL of glass beads (the diameter: 3 mm) was added to perform pulverization and dispersion for 10 hours by means of a batch-type sand mill (manufactured by Kanpe Hapio Co., Ltd.), to thereby prepare Crystalline Polyester Dispersion Liquid 1.

—Synthesis of Organic Particle Emulsion—

A reaction vessel equipped with a stirring rod and a thermometer was charged with 683 parts by mass of water, 11 parts by mass of a sodium salt of sulfuric acid ester of methacrylic acid-ethylene oxide adduct (ELEMINOL RS-30, manufactured by Sanyo Chemical Industries, Ltd.), 138 parts by mass of styrene, 138 parts by mass of methacrylic acid and 1 part by mass of ammonium persulfate, and the resulting mixture was stirred for 15 minutes at 400 rpm to prepare a white emulsion. The obtained emulsion was heated until the internal system temperature reached 75° C., and then was allowed to react for 5 hours. Subsequently, a 1% by mass aqueous ammonium persulfate solution (30 parts by mass) was added to the reaction mixture, followed by aging for 5 hours at 75° C., to thereby prepare an aqueous dispersion liquid (Fine Particle Dispersion Liquid) of a vinyl-based resin (a copolymer of styrene/methacrylic acid/sodium salt of sulfuric acid ester of methacrylic acid ethylene oxide adduct).

—Preparation of Aqueous Phase—

Water (990 parts by mass), 83 parts by mass of the particle dispersion liquid, 37 parts by mass of a 48.5% by mass sodium dodecyldiphenyl ether disulfonate aqueous solution (ELEMINOL MON-7, product of Sanyo Chemical Industries Ltd.) and 90 parts by mass of ethyl acetate were mixed together and stirred to obtain an opaque white liquid, which was used as an aqueous phase.

—Emulsification and Removal of Solvent—

A vessel was charged with 664 parts by mass of the prepared pigment-wax dispersion liquid (amount of the wax being 4% by mass relative to the resulting toner), 109.4 parts by mass of the synthesized polyester prepolymer, 150 parts by mass of Crystalline Polyester Dispersion Liquid 1 (amount of the crystalline polyester resin being 6% by mass relative to the resulting toner), and 4.6 parts by mass of the synthesized ketimine compound, and the mixture was mixed for 1 minute at 5,000 rpm with a TK homomixer (manufactured by Tokushu Kika Kogyo Co., Ltd.) to thereby prepare an oil phase.

Next, a vessel was charged with 850 parts by mass of the prepared oil phase, and 1,200 parts by mass of the prepared aqueous phase, and the mixture was mixed for 20 minutes at 13,000 rpm by a TK homomixer to thereby obtain emulsified slurry. A vessel equipped with a stirrer and a thermometer was charged with a mixture in which 410 parts by mass of ion-exchanged water was added to 2,050 parts by mass of the obtained emulsified slurry, and the solvent was removed from the mixture for 8 hours at 30° C., followed by subjecting the mixture to aging for 4 hours at 45° C., to thereby obtain dispersion slurry.

—Washing and Drying—

After filtering the obtained dispersion slurry (100 parts by mass) under the reduced pressure, 100 parts by mass of ion-exchanged water was added to the filtration cake, and the mixture was mixed with a TK homomixer (manufactured by Tokushu Kika Kogyo Co., Ltd.) for 10 minutes at 12,000 rpm, followed by filtration. To this, 100 parts by mass of 10% by mass aqueous sodium hydroxide solution was added, and the mixture was mixed for 30 minutes at 12,000 rpm by means of the TK homomixer, followed by subjecting to filtration under the reduced pressure. To the resultant, 100 parts by mass of 10% by mass hydrochloric acid was added, and the mixture was mixed for 10 minutes at 12,000 rpm by means of the TK homomixer, followed by subjecting to filtration. Then, 300 parts by mass of ion-exchanged water was added, and the mixture was mixed for 10 minutes at 12,000 rpm by means of the TK homomixer, followed by subjecting to the filtration. This operation was performed twice, to thereby obtain a filtration cake. The obtained filtration cake was dried by an air-circulating drier for 48 hours at 45° C., and was then passed through a sieve with a mesh size of 75 μm, to thereby prepare Toner Based Particles 1 of Example 1.

Example 2

Production of Toner

Toner Base Particles 2 of Example 2 were produced in the same manner as in Example 1, provided that in the preparation of the oil phase, the amount of the synthesized wax dispersant was changed from 77 parts by mass to 66 parts by mass (the amount of the wax dispersant being 60% by mass relative to the wax), and in the emulsification and removal of the solvent, the amount of the ion-exchanged water was changed from 410 parts by mass to 210 parts by mass.

Example 3

Production of Toner

Toner Base Particles 3 of Example 3 were produced in the same manner as in Example 1, provided that in the emulsification and removal of the solvent, the amount of the ion-exchanged water was changed from 410 parts by mass to 310 parts by mass.

Example 4

Production of Toner

Toner Base Particles 4 of Example 4 were produced in the same manner as in Example 1, provided that in the preparation of the oil phase, the amount of the wax dispersant was changed from 77 parts by mass to 72 parts by mass (the amount of the wax dispersant being 65% by mass relative to the wax).

Example 5

Production of Toner

Toner Base Particles 5 of Example 5 were produced in the same manner as in Example 1, provided that in the emulsification and removal of the solvent, the amount of the ion-exchanged water was changed from 410 parts by mass to 350 parts by mass.

Example 6

Production of Toner

Toner Base Particles 6 of Example 6 were produced in the same manner as in Example 1, provided that in the preparation of the oil phase, the microcrystalline wax was replaced with paraffin wax (HNP-9, manufactured by Nippon Seiro Co., Ltd.).

Example 7

Toner Base Particles 7 of Example 7 were produced in the same manner as in Example 1, provided that in the emulsification and removal of the solvent, Crystalline Polyester Dispersion Liquid 1 was replaced with Crystalline Polyester Dispersion Liquid 2 prepared in the following manner.

—Preparation of Crystalline Polyester Dispersion Liquid 2—

A 2 L-metal container was charged with 100 g of Crystalline Polyester Resin 2, and 400 g of ethyl acetate, and the mixture was heated at 75° C. to dissolve Crystalline Polyester Resin 2 therein, followed by quenching the resulting solution in an ice-water bath at the rate of 27° C./min. To this, 500 mL of glass beads (the diameter: 3 mm) was added to perform pulverization and dispersion for 10 hours by means of a batch-type sand mill (manufactured by Kanpe Hapio Co., Ltd.), to thereby prepare Crystalline Polyester Dispersion Liquid 2.

Example 8

Toner Base Particles 8 of Example 8 were produced in the same manner as in Example 1, provided that in the emulsification and removal of the solvent, Crystalline Polyester Dispersion Liquid 1 was replaced with Crystalline Polyester Dispersion Liquid 3 prepared in the following manner.

—Preparation of Crystalline Polyester Dispersion Liquid 3—

A 2 L-metal container was charged with 100 g of Crystalline Polyester Resin 3, and 400 g of ethyl acetate, and the mixture was heated at 75° C. to dissolve Crystalline Polyester Resin 3 therein, followed by quenching the resulting solution in an ice-water bath at the rate of 27° C./min. To this, 500 mL of glass beads (the diameter: 3 mm) was added to perform pulverization and dispersion for 10 hours by means of a batch-type sand mill (manufactured by Kanpe Hapio Co., Ltd.), to thereby prepare Crystalline Polyester Dispersion Liquid 3.

Comparative Example 1

Production of Toner

Toner Base Particles 9 of Comparative Example 1 were produced in the same manner as in Example 1, provided that in the preparation of the oil phase, the amount of the wax dispersant was changed from 77 parts by mass to 121 parts by mass (the amount of the wax dispersant being 110% by mass relative to the wax).

Comparative Example 2

Production of Toner

Toner Base Particles 10 of Comparative Example 2 were produced in the same manner as in Example 1, provided that in the preparation of the oil phase, the amount of the wax dispersant was changed from 77 parts by mass to 9 parts by mass (the amount of the wax dispersant being 8% by mass relative to the wax), and in the emulsification and removal of the solvent, 410 parts by mass of the ion-exchanged water was not added.

Comparative Example 3

Production of Toner

Toner Base Particles 11 of Comparative Example 3 were produced in the same manner as in Example 1, provided that in the emulsification and removal of the solvent, the amount of the ion-exchanged water was changed from 410 parts by mass to 500 parts by mass.

Comparative Example 4

Production of Toner

Toner Base Particles 12 of Comparative Example 4 were produced in the same manner as in Example 1, provided that in the preparation of the oil phase, the amount of the wax dispersant was changed from 77 parts by mass to 85 parts by mass (the amount of the wax dispersant being 77% by mass relative to the wax), and in the emulsification and removal of the solvent, the duration of the aging at 45° C. was changed from 4 hours to 8 hours, and the amount of the ion-exchanged water was changed from 410 parts by mass to 500 parts by mass.

Comparative Example 5

Production of Toner

Toner Base Particles 13 of Comparative Example 5 were produced in the same manner as in Example 1, provided that in the preparation of the oil phase, the amount of the wax dispersant was changed from 77 parts by mass to 11 parts by mass (the amount of the wax dispersant being 10% by mass relative to the wax), and in the emulsification and removal of the solvent, the amount of the ion-exchanged water was changed from 410 parts by mass to 10 parts by mass.

Comparative Example 6

Production of Toner

Toner Base Particles 14 of Comparative Example 6 were produced in the same manner as in Example 1, provided that in the preparation of the oil phase, the amount of the wax dispersant was changed from 77 parts by mass to 33 parts by mass (the amount of the wax dispersant being 30% by mass relative to the wax), and in the emulsification and removal of the solvent, the amount of the ion-exchanged water was changed from 410 parts by mass to 310 parts by mass.

Comparative Example 7

Toner Base Particles 15 of Comparative Example 7 were produced in the same manner as in Example 1, provided that in the emulsification and removal of the solvent, Crystalline Polyester Dispersion Liquid 1 was replaced with Crystalline Polyester Dispersion Liquid 4 prepared in the following manner.

—Preparation of Crystalline Polyester Dispersion Liquid 4—

A 2 L-metal container was charged with 100 g of Crystalline Polyester Resin 4, and 400 g of ethyl acetate, and the mixture was heated at 75° C. to dissolve Crystalline Polyester Resin 4 therein, followed by quenching the resulting solution in an ice-water bath at the rate of 27° C./min. To this, 500 mL of glass beads (the diameter: 3 mm) was added to perform pulverization and dispersion for 10 hours by means of a batch-type sand mill (manufactured by Kanpe Hapio Co., Ltd.), to thereby prepare Crystalline Polyester Dispersion Liquid 4.

—Processing with External Additives—

Toner base particles 1 to 15 (100 parts by mass each) of Examples 1 to 8 and Comparative Examples 1 to 7 were each mixed with external additives, i.e. 0.7 parts by mass of hydrophobic silica (HDK H2000, manufactured by Clariant Japan K.K.), and 0.3 parts by mass of hydrophobic titanium oxide by means of HENSCHEL MIXER (manufactured by Mitsui Mining Co., Ltd.) to thereby prepare a toner.

The fluidized powder characteristic value, BET specific surface area, intensity ratio (P2850/P828), glass transition temperature, volume average particle diameter Dv, number average particle diameter Dn, and ratio Dv/Dn of Toners 1 to 15 obtained in Examples 1 to 8 and Comparative Examples 1 to 7 were measured in the following manner. The results are presented in Tables 2-2 and 2-3.

<Fluidized Powder Characteristic Value of Toner>

The fluidized powder characteristic value of the toner was determined by means of a powder rheometer (FT4, manufactured by Malvern Instruments Ltd.). As a sample of the toner, the toner that had been left to stand for 8 hours or longer in the environment having the temperature of 22° C. and the humidity of 50% RH was used to avoid any influence of the temperature and humidity in the measurement.

At first, a split vessel having an inner diameter of 50 mm (including a 160 mL vessel having a height of 89 mm, and a cylinder having a height of 51 mm and disposed above the vessel so that the split vessel can be separated into an upper part and a lower part) was charged with the toner in an amount sufficient to fill the vessel to or over the height of 89 mm. Then, the sample was homogenized by gently stirring the charged toner. Note that, the homogenization of the sample was referred to as conditioning, hereinafter. For the conditioning, stirring was gently performed with a rotor in the rotational direction that did not receive resistance from the toner so as not to apply excessive stress to the toner filled in the vessel. In this manner, excess air, or partial stress was almost removed, to thereby turn the sample into a homogeneous state. As for the specific conditions of the conditioning, the stirring was performed at an angle of approach of 5°, and tip speed of 60 mm/sec. During this operation, a propeller rotor (e.g., propeller) moved downwards at the same time as the rotating motion, so that the tip of the propeller rotor spirally moved. Note that, the angle that the spiral motion of the tip of the propeller made was referred to as "an angle of approach" hereinafter.

After repeating the operation of the conditioning four times, the upper edge part of the split vessel was quietly moved, and the toner within the vessel was leveled at the height of 89 mm, to thereby obtain the toner filling the 160 mL-vessel.

The obtained toner was transferred to a 200 mL-vessel having an inner diameter of 50 mm, and height of 140 mm. After performing the series of the operations mentioned above three times, the running torque and vertical load of the propeller rotor were measured under the conditions that the rotor was rotated at the tip speed of 100 mm/sec and moved in the vessel from the height of 100 mm to 10 mm from the bottom surface of the vessel with the angle of approach of −5°.

Note that, the rotational direction of the propeller for this is a reverse direction (clockwise direction seen from the top) to the direction during the conditioning. Note that, as the rotation blade, a 48 mm-diameter blade that was a double-bladed propeller (of Malvern Instruments Ltd.) was used (see FIG. 3).

The relationship between the height H from the bottom surface and the vertical load, and the relationship between H and the running torque are illustrated in FIGS. 1A and 1B, respectively.

FIG. 2 illustrates the energy gradient (mJ/mm) with respect to the height H, which is obtained from the running torque and vertical load. The area (the part marked with slanting lines in FIG. 2) obtained by integrating the energy gradient is the flow energy amount (mJ). The flow energy amount was determined by integrating the section from the height that was 10 mm from the bottom surface to the height that was 100 mm from the bottom surface. In order to reduce the influence from an error, the average value obtained after performing a cycle of the conditioning and aeration with the maximum quantity of air flow of 80 L/min 5 times was determined as the flow energy amount (mJ), and the average value after measuring the flow energy amount 5 times without aeration was determined as a pre-aeration flow energy amount (mJ). The fluidized powder characteristic value was obtained based on the following equation.

Fluidized powder characteristic value(%)=(flow energy amount/pre-aeration flow energy amount)×100

<BET Specific Surface Area of Toner>

The BET specific surface area was measured by means of an automatic specific surface area/pore distribution measuring device (TriStar3000, manufactured by Shimadzu Corporation). About 0.5 g of the toner was weight and placed in a sample cell, and the sample was then vacuum dried for 24 hours by a pretreatment device (SmartPrep, manufactured by Shimadzu Corporation) to thereby remove impurities and moisture from the surfaces of the toner particles. After the pretreatment, the sample was then set in the measuring device mentioned above (TriStar3000, manufactured by Shimadzu Corporation), a relationship between the absorption amount of the nitrogen gas and the relative pressure was determined. From this relationship, the BET specific surface area was determined in accordance with a BET multi-point method.

<Intensity Ratio (P2850/P828) of Toner>

The intensity ratio P2850/P828 of the peak intensity (P2850) at 2850 $cm^{-1}$, which was attributed from the wax and crystalline polyester resin, to the peak intensity (P828) at 828 $cm^{-1}$, which was attributed from the binder resin was measured in the following manner.

At first, 3 g of the toner was pressed for 1 minute with load of 6 tons (t) by means of an automatic pelletizer (Type-M No. 50 BRP-E, manufactured by Maekawa Testing Machine MFG. CO., Ltd.), to thereby prepare a pellet having a diameter of 40 mm and a thickness of about 2 mm.

The surface of the obtained toner pellet was subjected to the measurement of total reflectance infrared spectroscopy (FTIR-ATR). The used FTIR scopic device was Spectrum One (manufactured by PerkinElmer, Inc.) connected with MultiScope FTIR unit, and the measurement was performed with micro ATR of germanium (Ge) crystal having a diameter of 100 μm. The measurement was performed on four spots with conditions that the incident angle of the infrared ray was 41.5°, resolution of 4 $cm^{-1}$, and multiplication of 20 times, and the peak intensity was determined from the average value of the obtained values.

<Glass Transition Temperature of Toner>

The glass transition temperature of the toner was measured by means of a differential scanning calorimeter (DSC-60, manufactured by Shimadzu Corporation) in the following manner.

Firstly, about 5.0 mg of the toner was added to an aluminum sample container. The sample container was placed on a holder unit, and set in an electric furnace. Next, in a nitrogen atmosphere, the toner was heated from 0° C. to 150° C. at a temperature increasing rate of 10° C./min. Then, the toner was cooled from 150° C. to 0° C. at a temperature decreasing rate of 10° C./min, followed by heating to 150° C. at the temperature increasing rate of 10° C./min, to thereby measure a DSC curve by means of a differential scanning calorimeter (DSC-60, manufactured by Shimadzu Corporation).

Using an analysis program in the DSC-60 system, a DSC curve corresponding to the first temperature elevation was selected from the obtained DSC curve, and a glass transition temperature Tg1st of the sample for the first temperature elevation was determined using "endothermic shoulder temperature" in the analysis program. Next, the DSC curve corresponding to the second temperature elevation was selected, and a glass transition temperature Tg2nd of the sample for the second temperature elevation was determined using "endothermic shoulder temperature".

<Volume Average Particle Diameter Dv, Number Average Particle Diameter Dn, and Ratio Dv/Dn of Toner>

The volume average particle diameter and number average particle diameter of the toner was measured by the coulter counter method as follows.

The volume average particle diameter and number average particle diameter of the toner was measured by a measuring device (Coulter Counter TA-II, manufactured by Beckman Coulter, Inc.) connected with PC-9801 personal computer (manufactured by NEC Corporation) via an interface (of I-JUSE) outputting the volume average particle diameter and number average particle diameter.

Specifically, 0.1 mL to 5 mL of a surfactant (alkyl benzene sulfonate) was added as a dispersant to 100 mL to 150 mL of an electrolyte (ISOTON-II, of Beckman Coulter, Inc.). Next, to the resulting mixture, 2 mg to 20 mg of the toner was added and suspended, and then the mixture was dispersed by means of an ultrasonic wave disperser for 1 minute to 3 minutes. The volume and number of the toner particles were measured from the obtained dispersion liquid using the above-mentioned measuring device with an aperture of 100 μm, and then the volume average particle diameter and number average particle diameter of the toner were calculated.

From the calculated volume average particle diameter Dv and number average particle diameter Dn, a ratio (Dv/Dn) was obtained.

Note that, as a channel, the following 13 channels were used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement were particles having the diameters of 2.00 μm or larger, but smaller than 40.30 μm.

<Production of Developer>

Each of the external additive-processed toners (5% by mass) was mixed with 95% by mass of copper-zinc ferrite carrier coated with a silicone resin, and having the average particle diameter of 40 μm to thereby prepare developers.

<Evaluation>

The prepared toners and developers of Examples 1 to 8 and Comparative Examples 1 to 7 were each evaluated in terms of various properties thereof in the following manners. The results are presented in Table 2-2.

<Transfer Properties>

In order to determine transfer properties of the toner, a transfer rate was determined in the following manner. Specifically, a photocopier (imagio MP C4500, manufactured by Ricoh Company Limited) was used, and the photocopier was driven to develop an entire area with black, and stopped in the middle of the transferring procedure. The toner present on the untransfer part and transfer part of the latent electrostatic image bearing member was taken by an adhesive paper (Scotch Mending Tape 810, manufactured by Sumitomo 3M Limited) of given mass and constant area, and the mass of the toner was weight. The transfer rate was calculated by the following expression 1, and the transfer properties of the toner were evaluated based on the following criteria.

[(mass of the toner in the untransfer part−mass of the toner in the transfer part)/mass of the toner in the untransfer part]×100 <<Expression 1>>

[Evaluation Criteria]

A: 95% or higher

B: 94% to 90%

C: 89% to 85%

D: 84% or lower

<Low Temperature Fixing Ability and Hot Offset Resistance>

A copying test was performed to determine low temperature fixing ability and hot offset resistance of the toner by means of a device that was a photocopier (imagio MP C4500, manufactured by Ricoh Company Limited) a fixing unit of which had been modified, and in which paper (Type 6200, manufactured by Ricoh Company Limited) was set. The cold offset temperature (i.e. the lowest fixing temperature) and the hot offset temperature (i.e. the hot offset resistive temperature) were determined by changing the fixing temperature, and the results were evaluated in terms of the low temperature fixing ability and hot offset resistance, based on the following criteria.

Note that, the lowest fixing temperature of a conventional low temperature fixing toner is about 140° C. to about 150° C.

[Evaluation Criteria for Low Temperature Fixing Ability]

A: Cold offset occurred at the temperature lower than 110° C.

B: Cold offset occurred at the temperature ranging from 110° C. to 120° C.

C: Cold offset occurred at the temperature ranging from 121° C. to 130° C.

D: Cold offset occurred at the temperature ranging from 131° C. to 140° C.

E: Cold offset occurred at the temperature of 141° C. or higher

[Evaluation Criteria for Hot Offset Resistance]

A: Hot offset occurred at the temperature of 175° C. or higher

B: Hot offset occurred at the temperature ranging from 170° C. to 174° C.

C: Hot offset occurred at the temperature ranging from 165° C. to 169° C.

D: Hot offset occurred at the temperature ranging from 160° C. to 164° C.

E: Hot offset occurred at the temperature of 159° C. or lower

TABLE 2-1

| | Toner | Amount of wax dispersant: Relative to oil phase (mass parts) | Amount of wax dispersant: Relative to wax (mass %) | Amount of ion-exchanged water added to 100 parts by mass of emulsified slurry (mass parts) |
|---|---|---|---|---|
| Ex. 1 | Toner 1 | 77 | 70 | 20 |
| Ex. 2 | Toner 2 | 66 | 60 | 10.2 |
| Ex. 3 | Toner 3 | 77 | 70 | 15.1 |
| Ex. 4 | Toner 4 | 72 | 65 | 20 |
| Ex. 5 | Toner 5 | 77 | 70 | 17.1 |
| Ex. 6 | Toner 6 | 77 | 70 | 20 |
| Ex. 7 | Toner 7 | 77 | 70 | 20 |
| Ex. 8 | Toner 8 | 77 | 70 | 20 |
| Comp. Ex. 1 | Toner 9 | 121 | 110 | 20 |
| Comp. Ex. 2 | Toner 10 | 9 | 8 | 0 |
| Comp. Ex. 3 | Toner 11 | 77 | 70 | 24.4 |
| Comp. Ex. 4 | Toner 12 | 85 | 77 | 24.4 |
| Comp. Ex. 5 | Toner 13 | 11 | 10 | 0.5 |
| Comp. Ex. 6 | Toner 14 | 33 | 30 | 15.1 |
| Comp. Ex. 7 | Toner 15 | 77 | 70 | 20 |

TABLE 2-2

| | Fluidized powder characteristic value(%) | BET specific surface area ($m^2/g$) | Intensity ratio (P2850/P828) | Transfer properties | Low temperature fixing ability | Hot offset resistance |
|---|---|---|---|---|---|---|
| Ex. 1 | 35 | 2.9 | 0.11 | B | B | B |
| Ex. 2 | 44 | 3.9 | 0.20 | B | A | A |
| Ex. 3 | 40 | 3.4 | 0.19 | B | A | A |
| Ex. 4 | 42 | 3.0 | 0.15 | B | A | A |
| Ex. 5 | 37 | 3.3 | 0.12 | A | A | A |
| Ex. 6 | 39 | 3.1 | 0.10 | B | A | B |
| Ex. 7 | 38 | 3.1 | 0.13 | B | B | A |
| Ex. 8 | 35 | 2.8 | 0.12 | B | A | B |
| Comp. Ex. 1 | 32 | 2.7 | 0.09 | A | E | E |
| Comp. Ex. 2 | 48 | 4.2 | 0.22 | D | A | A |
| Comp. Ex. 3 | 35 | 2.7 | 0.11 | A | E | E |
| Comp. Ex. 4 | 33 | 2.9 | 0.12 | B | E | E |

TABLE 2-2-continued

| | Fluidized powder characteristic value(%) | BET specific surface area ($m^2/g$) | Intensity ratio (P2850/P828) | Transfer properties | Low temperature fixing ability | Hot offset resistance |
|---|---|---|---|---|---|---|
| Comp. Ex. 5 | 44 | 4.1 | 0.18 | D | A | A |
| Comp. Ex. 6 | 34 | 3.8 | 0.22 | B | A | A |
| Comp. Ex. 7 | 33 | 2.5 | 0.09 | D | A | B |

TABLE 2-3

| | Tg (° C.) | | Dv | Dn | |
|---|---|---|---|---|---|
| | Tg1st | Tg2nd | (μm) | (μm) | Dv/Dn |
| Ex. 1 | 57 | 34 | 5.2 | 4.7 | 1.11 |
| Ex. 2 | 56 | 33 | 4.9 | 4.3 | 1.13 |
| Ex. 3 | 57 | 34 | 5.1 | 4.6 | 1.10 |
| Ex. 4 | 54 | 31 | 5.3 | 4.7 | 1.12 |
| Ex. 5 | 55 | 32 | 5.1 | 4.7 | 1.09 |
| Ex. 6 | 58 | 34 | 5.3 | 4.7 | 1.12 |
| Ex. 7 | 59 | 35 | 5.2 | 4.7 | 1.11 |
| Ex. 8 | 54 | 32 | 4.9 | 4.4 | 1.12 |
| Comp. Ex. 1 | 59 | 36 | 4.9 | 4.4 | 1.12 |
| Comp. Ex. 2 | 54 | 31 | 5.0 | 4.4 | 1.13 |
| Comp. Ex. 3 | 56 | 33 | 5.2 | 4.6 | 1.14 |
| Comp. Ex. 4 | 55 | 32 | 5.1 | 4.4 | 1.15 |
| Comp. Ex. 5 | 54 | 31 | 4.8 | 4.2 | 1.14 |
| Comp. Ex. 6 | 55 | 32 | 5.4 | 4.7 | 1.15 |
| Comp. Ex. 7 | 51 | 28 | 4.9 | 4.3 | 1.13 |

The toner of the present invention has high transfer efficiency without causing retransfer, and excellent low temperature fixing ability, and is suitably used for electrophotographic high quality image formations.

This application claims priority to Japanese patent application No. 2010-254174, filed on Nov. 12, 2010, and incorporated herein by reference.

What is claimed is:

1. A toner, comprising:

a binder resin;

a crystalline polyester resin;

a colorant;

wax, and a wax dispersant, wherein the toner has a fluidized powder characteristic value measured with a powder rheometer of 35% to 45%, and a BET specific surface area of 2.8 $m^2/g$ to 4 $m^2/g$, and wherein the toner has an intensity ratio P2850/P828 of 0.10 to 0.20, where P2850 is an intensity of a peak at 2850 $cm^{-1}$ which is attributed from the wax and the crystalline polyester resin, and P828 is an intensity of a peak at 828 $cm^{-1}$ which is attributed from the binder resin, as measured by total reflectance infrared spectroscopy.

2. The toner according to claim 1, wherein the crystalline polyester resin has a weight average molecular weight Mw of 3,000 to 30,000, a number average molecular weight Mn of 1,000 to 10,000, and a ratio Mw/Mn of 1 to 10, where the ratio Mw/Mn is a ratio of the weight average molecular weight Mw of the crystalline polyester resin to the number average molecular weight Mn of the crystalline polyester resin.

3. The toner according to claim 1, wherein the crystalline polyester resin has a molecular weight distribution in which a proportion of the crystalline polyester resin having a number molecular weight of 500 or smaller is 0% to 2%, and a proportion of the crystalline polyester resin having a number molecular weight of 1,000 or smaller is 0% to 4%.

4. The toner according to claim 1, wherein the crystalline polyester resin is synthesized from a C4-C12 saturated dicarboxylic acid and a C4-C12 saturated diol.

5. The toner according to claim 1, wherein the crystalline polyester resin is contained in the toner in an amount of 5% by mass to 25% by mass.

6. The toner according to claim 1, wherein the toner is a toner obtained by the method comprising:

dispersing an oil phase in an aqueous medium to form an O/W dispersion liquid, where the oil phase is prepared by dissolving or dispersing in an organic solvent a toner material containing at least the crystalline polyester resin, a non-crystalline polyester resin, the colorant, the wax, and the wax dispersant; and removing the organic solvent from the O/W dispersion liquid.

7. The toner according to claim 1, wherein the toner is a toner obtained by the method comprising:

dispersing an oil phase in an aqueous medium to form an emulsified dispersion liquid, where the oil phase is prepared by dissolving or dispersing in an organic solvent a toner material containing at least a compound containing an active hydrogen group, a binder resin precursor containing a site reactive to the compound containing an active hydrogen group, the crystalline polyester resin, a non-crystalline polyester resin, the colorant, the wax, and the wax dispersant;

allowing the binder resin precursor to react with the compound containing an active hydrogen group in the emulsified dispersion liquid; and removing the organic solvent from the emulsified dispersion liquid.

8. The toner according to claim 1, wherein the wax dispersant is a graft polymer of a polyolefin resin and alkyl(meth) acrylate.

9. The toner according to claim 1, wherein the wax is paraffin wax, microcrystalline wax, or a combination of paraffin wax and microcrystalline wax, and the wax is contained in the toner in an amount of 1% by mass to 10% by mass.

* * * * *